US009587532B1

(12) United States Patent
Au

(10) Patent No.: US 9,587,532 B1
(45) Date of Patent: Mar. 7, 2017

(54) OIL, COOLANT, AND EXAHUST GAS CIRCULATION SYSTEM, ELEMENTS AND KITS

(71) Applicant: Vinh Au, El Monte, CA (US)

(72) Inventor: Vinh Au, El Monte, CA (US)

( * ) Notice: Subject to any disclaimer, the term of this patent is extended or adjusted under 35 U.S.C. 154(b) by 794 days.

(21) Appl. No.: 13/778,866

(22) Filed: Feb. 27, 2013

Related U.S. Application Data

(60) Provisional application No. 61/613,997, filed on Mar. 22, 2012, provisional application No. 61/648,617, filed on May 18, 2012, provisional application No. 61/760,823, filed on Feb. 5, 2013, provisional application No. 61/769,746, filed on Feb. 26, 2013.

(51) Int. Cl.
*F01M 11/03* (2006.01)
*F01M 1/10* (2006.01)
*F01M 5/00* (2006.01)

(52) U.S. Cl.
CPC ..... *F01M 11/03* (2013.01); *F01M 1/10* (2013.01); *F01M 5/002* (2013.01); *F01M 2011/031* (2013.01); *F01M 2011/033* (2013.01)

(58) Field of Classification Search
CPC ..... F01M 11/03; F01M 2011/031; F01M 2011/033; F01M 1/10; F01M 2001/105; F01M 2001/1092; F01M 5/001; F01M 5/002; F01M 5/005; F01P 11/08; F02M 25/0728; F02M 25/0731; F02M 25/0737; B01D 35/005; F16N 39/005; F16N 39/02; F16N 39/06
USPC .... 123/196 A, 196 AB; 210/167.02, 167.06, 210/186
See application file for complete search history.

(56) References Cited

U.S. PATENT DOCUMENTS 3,859,216 A * 1/1975 Sisson et al. ..... 210/440
4,267,812 A * 5/1981 Aula et al. ..... 123/568.12
5,406,910 A * 4/1995 Wallin ..... 123/41.33
5,753,116 A * 5/1998 Baumann et al. ..... 210/206
(Continued)

OTHER PUBLICATIONS

"6.0L Power Stroke Diesel Engine", Oct. 28, 2003, International Truck and Engine Corporation, pp. 24-25.*
(Continued)

*Primary Examiner* — Hung Q Nguyen
*Assistant Examiner* — Robert Werner
(74) *Attorney, Agent, or Firm* — The Law Office of Austin Bonderer, PC; Austin Bonderer

(57) ABSTRACT

A system for circulating oil coolant and exhaust gas in an engine including an oil transfer tube, an oil filter cap, a bypass manifold, a coolant manifold, an adapter plate, a coolant filter hosing, a high pressure filter screen, a pump, and an EGR delete. The oil cap and the oil transfer tube act in conjunction to redirect the oil flow. The bypass manifold is able to replace an oil heat exchanger in the oil reservoir of an engine. The coolant manifold is able to redirect coolant. The adapter plate is able to be attached to an OEM oil heat exchanger. A coolant filter is able to filter coolant in the system. The EGR delete enables a system to bypass the EGR system in a simple convenient way. The high pressure filter screen is able to filter in high pressure environments. The pump can be used to direct coolant to the coolant manifold. These elements can be provided in a kit that is designed for certain makes of vehicles. A means to manufacture a bypass manifold is also provided.

21 Claims, 38 Drawing Sheets

(56) References Cited

U.S. PATENT DOCUMENTS

| | | | | |
|---|---|---|---|---|
| 5,970,960 | A * | 10/1999 | Azuma | 123/568.12 |
| 6,182,616 | B1 * | 2/2001 | Itoh | F01M 5/002 123/41.1 |
| 6,488,845 | B1 * | 12/2002 | Neufeld | B01D 29/21 210/232 |
| 7,597,202 | B1 * | 10/2009 | Tidwell | 210/435 |
| 8,375,917 | B1 * | 2/2013 | Neal et al. | 123/196 AB |
| 8,720,408 | B1 * | 5/2014 | Neal et al. | 123/196 AB |
| 8,833,333 | B1 * | 9/2014 | Neal et al. | 123/196 AB |
| 8,887,688 | B1 * | 11/2014 | Neal et al. | 123/196 R |
| 2010/0071639 | A1 * | 3/2010 | Wegner et al. | 123/41.08 |
| 2012/0180750 | A1 * | 7/2012 | Thienel | 123/196 A |

OTHER PUBLICATIONS

"BulletProofDiesel.com 6.4L Half Kit Installation Manual", Dec. 30, 2012, Neal Technologies, Inc, pp. 8, 11, 22-24.*

* cited by examiner

FIG. 11
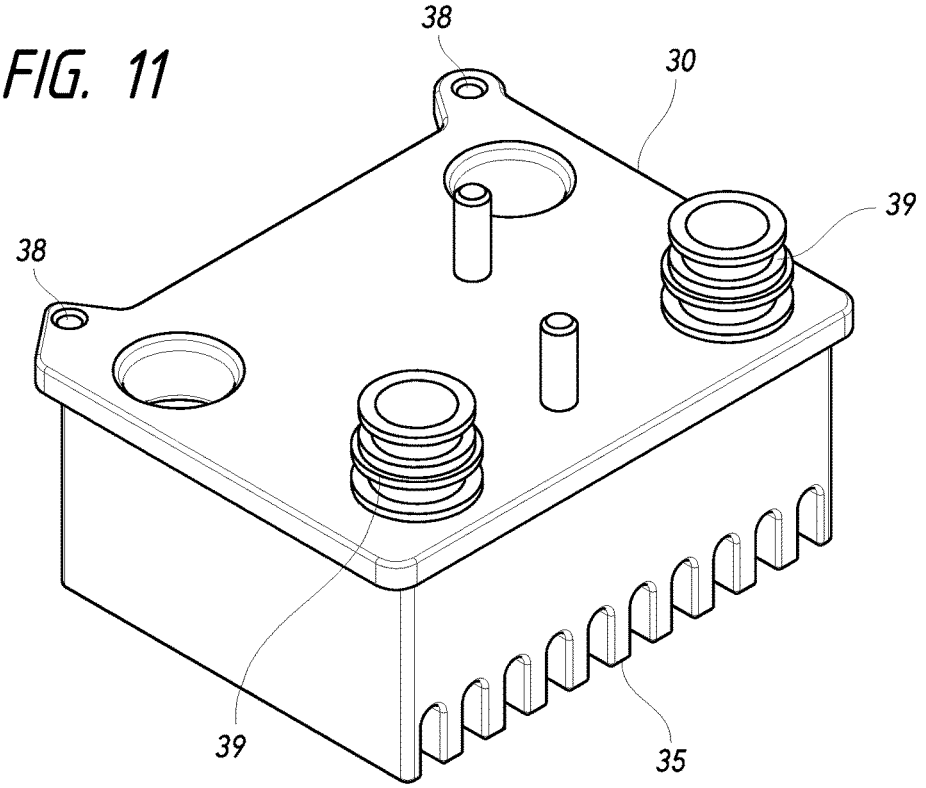
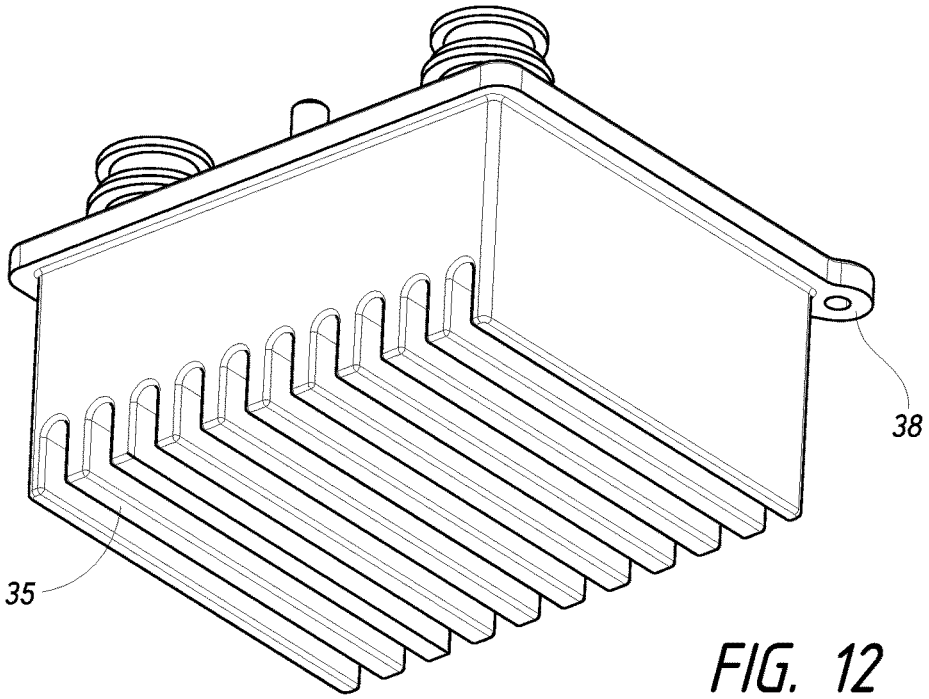
FIG. 12

FIG. 16
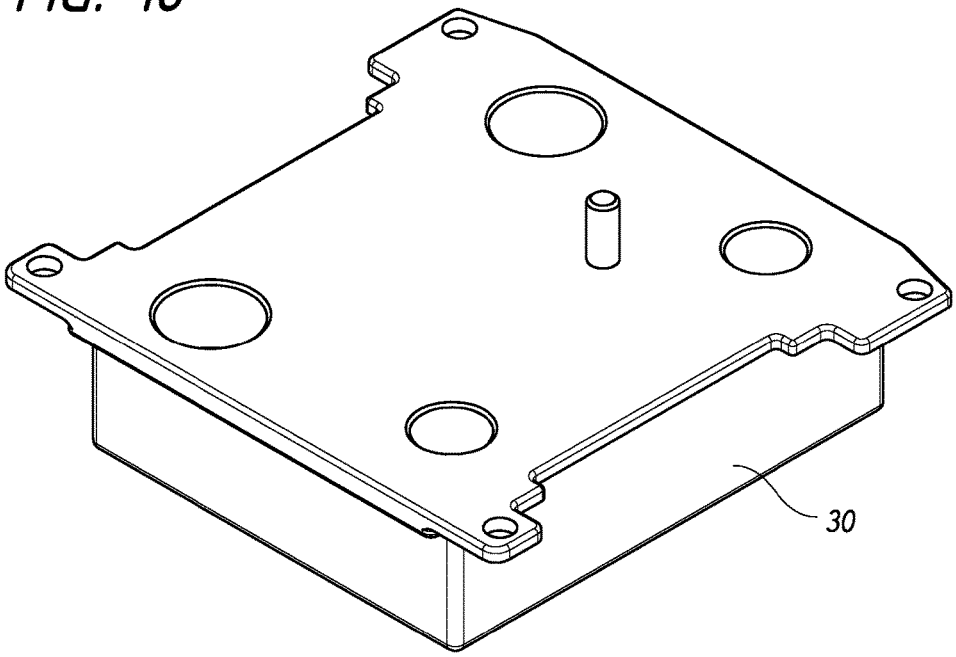
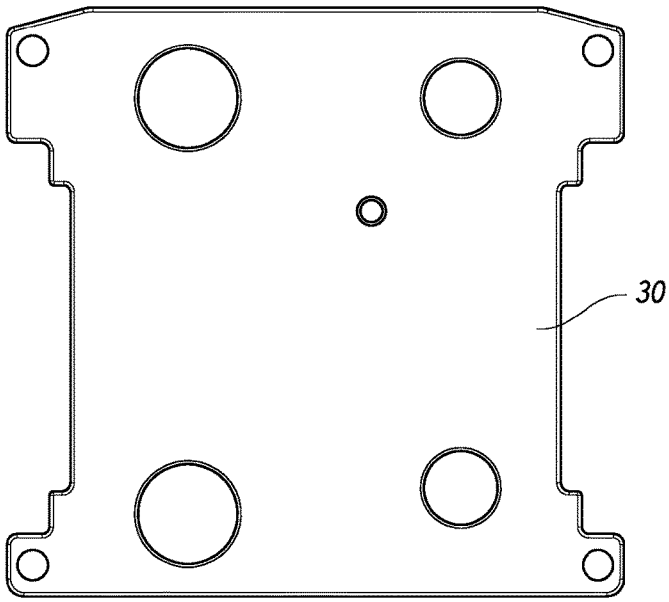
FIG. 17

OIL, COOLANT, AND EXAHUST GAS CIRCULATION SYSTEM, ELEMENTS AND KITS

BACKGROUND OF THE INVENTION

Some Original Equipment Manufacturer (OEM) factory oil heat exchangers are mounted internally inside the engine, which normally requires up to 7 to 11 hours of labor to remove the oil coolers for service or replacement. The factory oil heat exchangers are coolant cooled with coolant from the vehicle's engine. However the coolant is often contaminated with contaminants, such a casting sand from manufacturing, and corrosion from the various metal components inside engine.

Factory oil heat exchangers that are often plugged up with contaminates and are frequently replaced with a new unit which can be expensive due to the cost of the factory oil heat exchanger and the labor required to remove and replace the oil cooler.

The only products in the market that addresses this issue requires one to completely change out all the factory components and install an air cooled oil cooler, that is mounted in front of the vehicle and require many components, including an externally mounted spin on type oil filter. The water cooled design is not used in this type of product.

Additionally, current EGR systems in use do not fare well under very strenuous activity, like off road use. The EGR valve is susceptible to carbon buildup. There are current delete kits on the market that require flanges to be machined and attached to a U-shape hose, or tube, by welding or threading the plumbing into the flange, which attaches to the intake manifold. In addition, the current kits on the market require a hose and hose clamps, to secure the U shape hose/tube to the factory oil heat exchanger water jacket housing, and they require the use of the factory water jacket housing.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

FIGS. 11 and 12 show different view of an embodiment of the bypass manifold;

FIGS. 16 and 17 show an embodiment of the bypass manifold;

DETAILED DESCRIPTION OF THE DRAWINGS

The disclosure is illustrated by way of example and not by way of limitation in the figures of the accompanying drawings in which like references indicate similar elements. It should be noted that references to "an", "one", or "some" embodiment(s) in this disclosure are not necessarily to the same embodiment, and such references mean at least one.

The following embodiments are described in reference to working with engines and the Original Equipment Manufacture (OEM) parts of those engines. Examples of suitable engines with OEM parts will be the VT365, also known as the 6.0 L POWERSTROKE in 2003-2007 model year FORD SUPER DUTY trucks and 2003-2010 model year FORD E-Series vans/chassis cabs, and the MAXXFORCE 7, also known as the 6.4 L POWERSTROKE in 2008-2010 model year FORD SUPER DUTY trucks, both of the NAVISTAR International Corporation. It is known that the design of these engines has not changed in any significant way, at least not in view of the elements described herein. While described in relation to these engines, the embodiments are not limited thereto.

Figure 1:
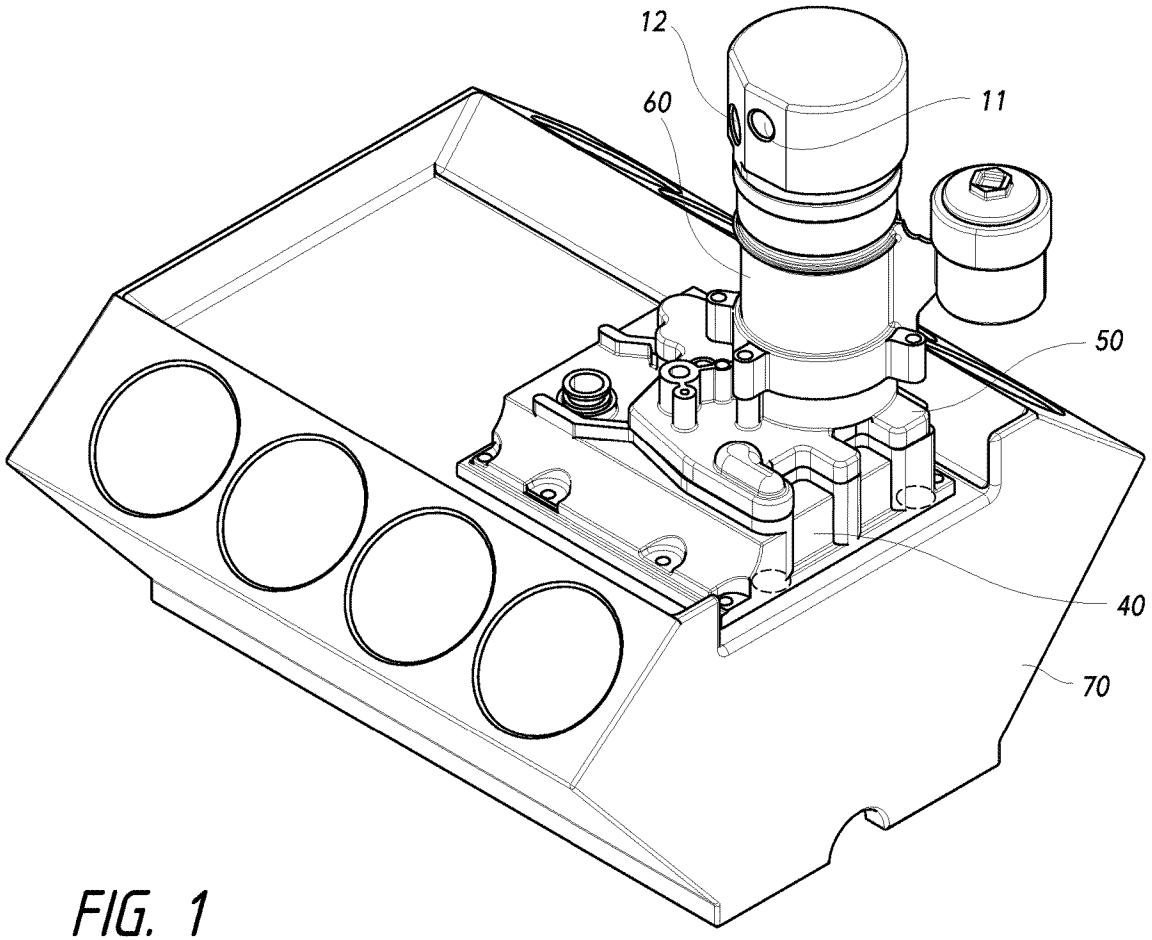
FIG. 1 shows an embodiment of the invention.
Figure 3:
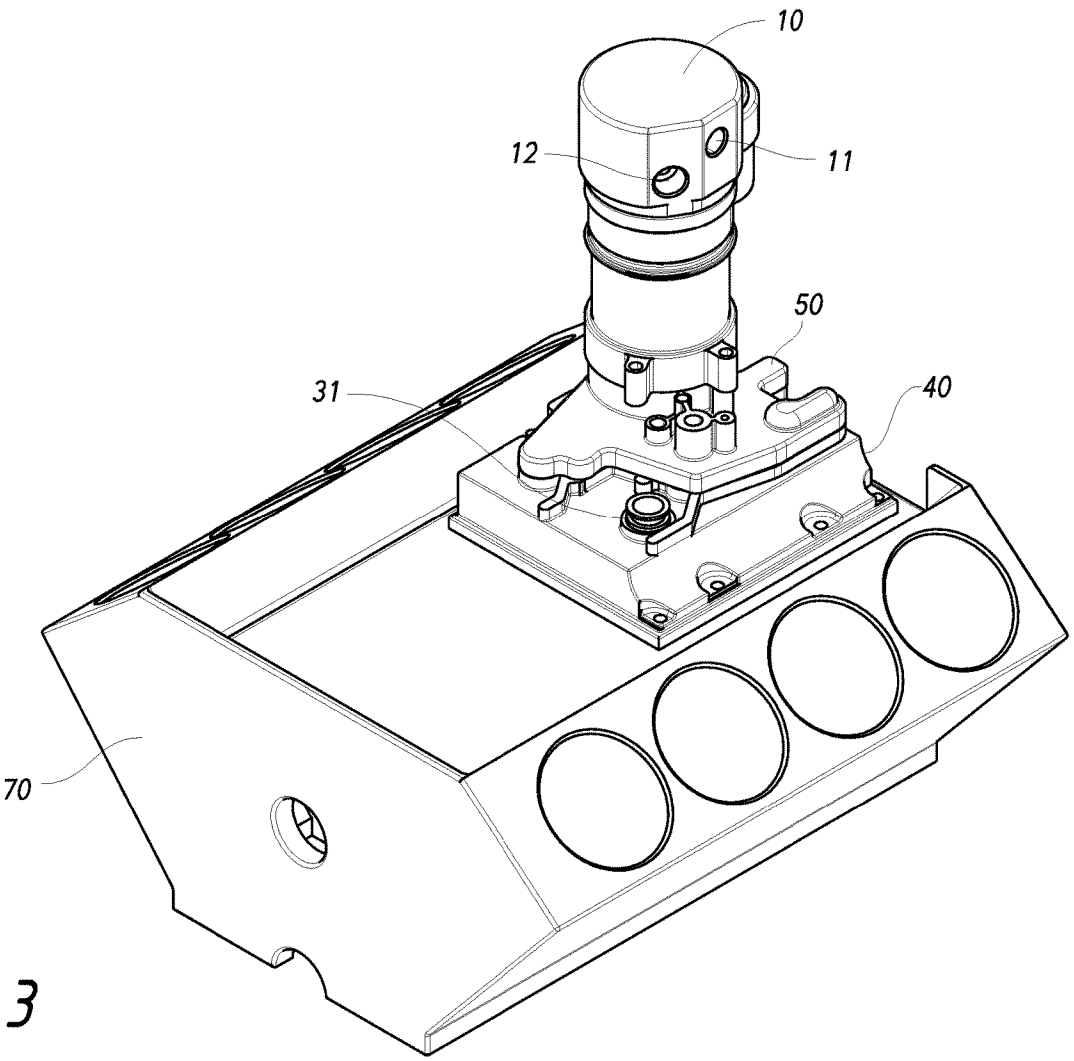
FIG. 3 is similar to FIG. 1, but viewed from a different angle.

Referring to FIGS. 1 and 3, an embodiment is shown having a bypass manifold 30 (shown in FIG. 4) resting in an engine block 70. The oil cooler housing lower 40 is engaged with the bypass manifold 30 and the oil cooler housing upper 50. The oil filter housing 60 is mounted on the oil cooler housing upper 50 and has an oil filter cap 10 secured thereon. The oil filter cap comprises an oil filter cap inlet 11 and an oil filter cap outlet 12. As can be seen in FIG. 3, in some embodiments, the bypass manifold coolant outlet 31 extends through the oil cooler housing lower 40.

Figure 2:
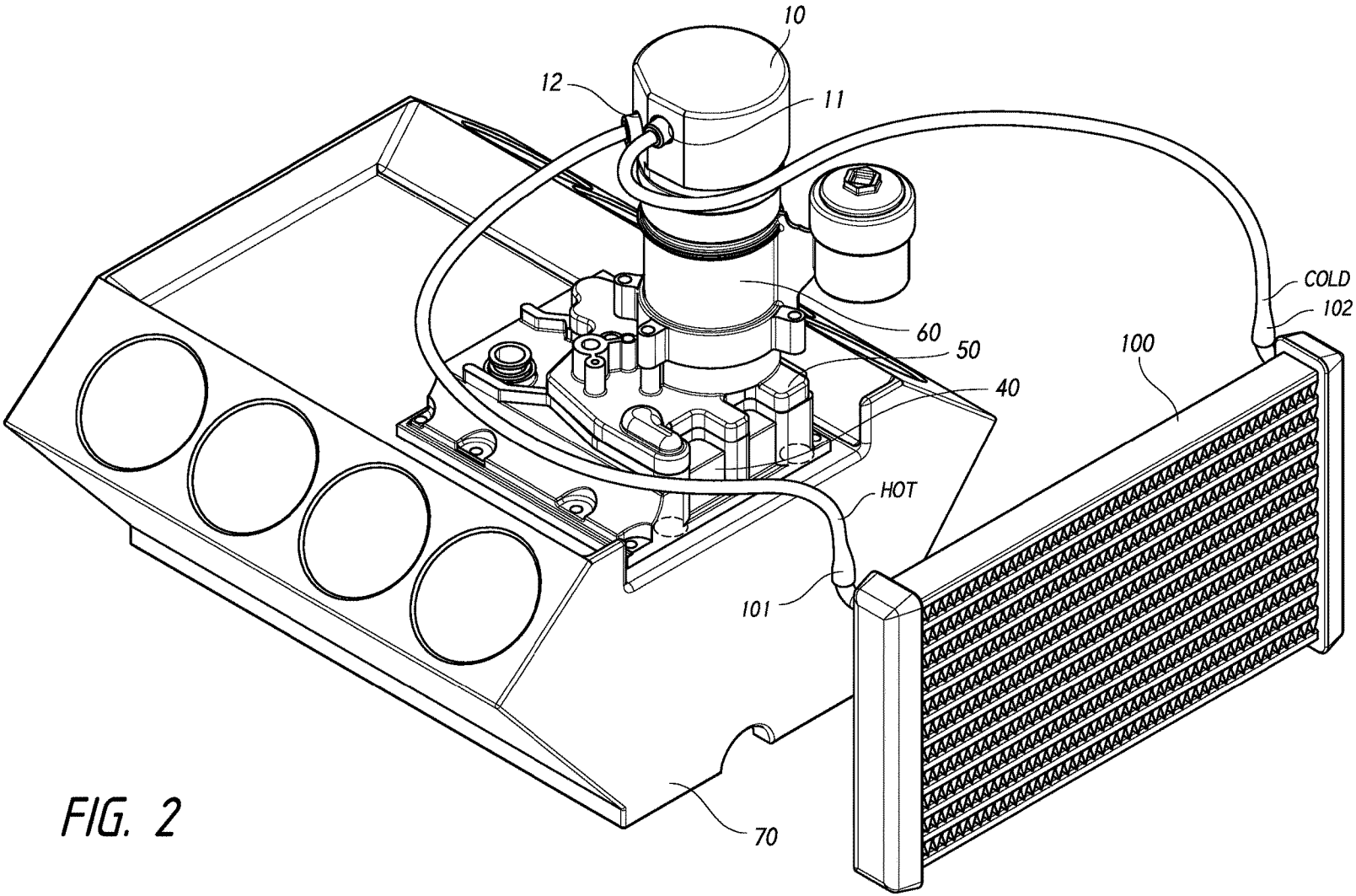
FIG. 2 shows an embodiment of the invention having an air cooled oil cooler.
Figure 36:
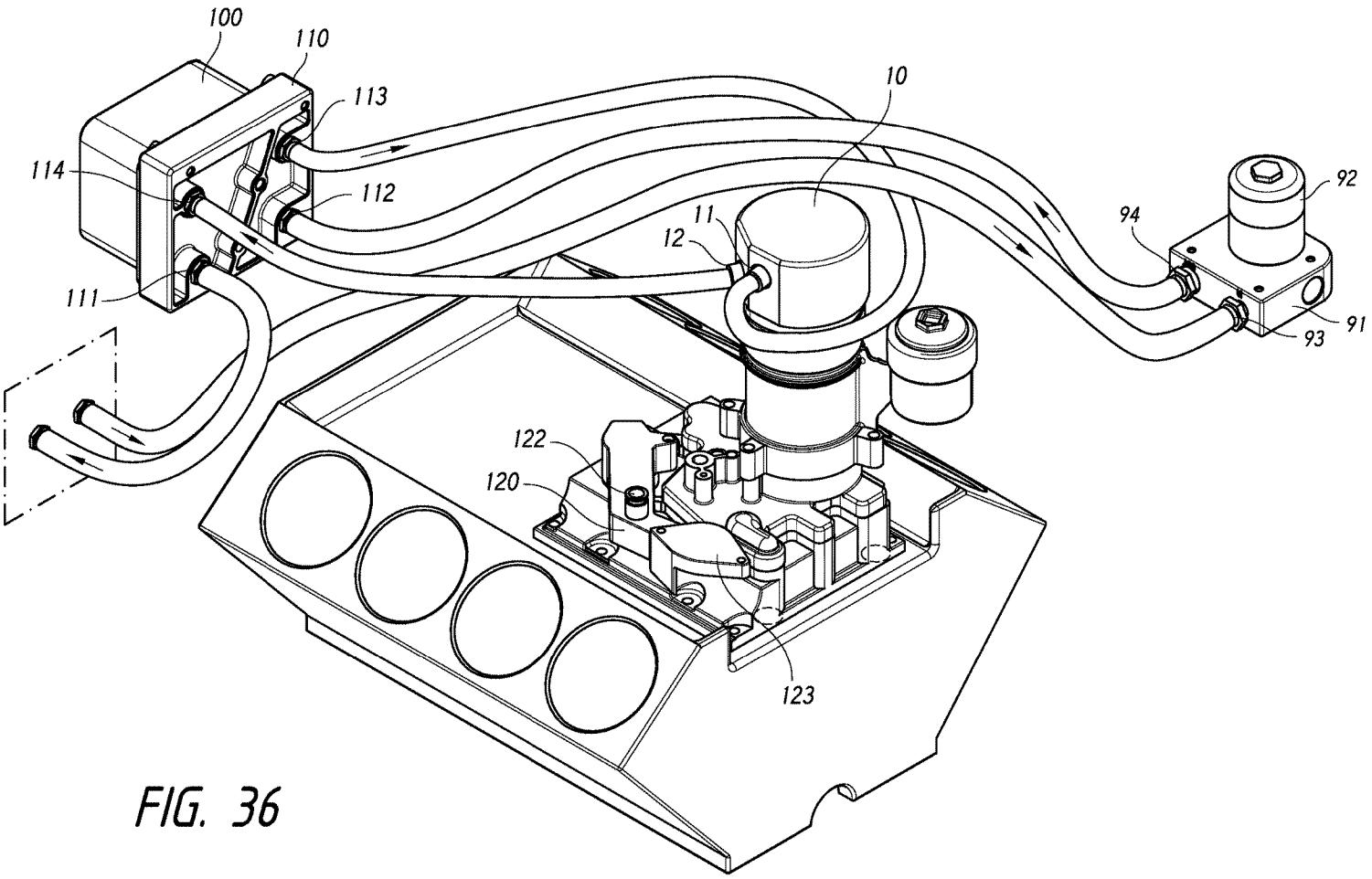
FIG. 36 shows an embodiment of the invention having coolant cooled oil cooler, a coolant manifold, and an adapter plate.

Referring to FIG. 2, an embodiment of the oil heat exchanger 100, as an air cooled heat exchanger, is shown. Conduits connect the oil filter cap 10 to the oil heat exchanger 100. In some embodiments, the air cooled oil heat exchanger 100 can be installed in front of the radiator of the vehicle. As can be seen, hot oil flows from the oil filter cap outlet 12, through a conduit, and into the oil heat exchanger oil inlet 101. In some embodiments employing the air cooled oil heat exchanger 100, air will dissipate heat from the oil flowing therethorough. The cooled oil will then flow out of the oil heat exchanger oil outlet 102, through a conduit, and into the oil filter cap inlet 11. In some embodiments, the oil heat exchanger 100 is a coolant cooled oil heat exchanger 100, and it can be the OEM heat exchanger 100 as shown in FIG. 36.

Figure 4:
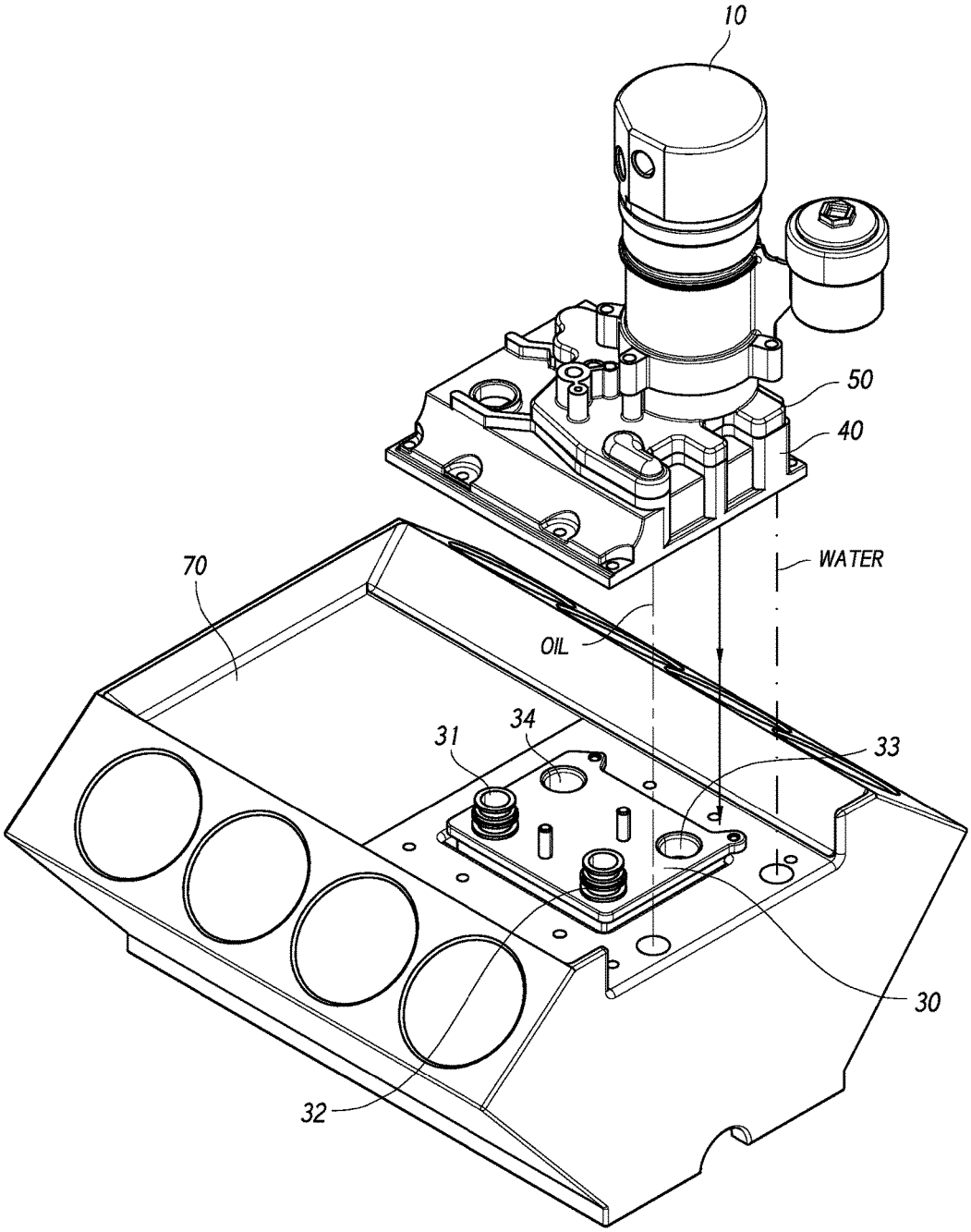
FIG. 4 is similar to FIG. 1, but shown in an exploded view.

Referring to FIG. 4, an exploded view of an embodiment having the bypass manifold 30 residing in the oil reservoir 71 of the engine block 70. Hot oil and cool water/coolant are pumped into the oil cooler housing lower 40 from the engine block 70. The hot oil will enter the oil cooler housing lower 40, and then it will flow in the hot oil channel 41. Coolant will also flow into the oil cooler housing lower and into the cold coolant channel 42. The engine block 70 can be an OEM engine block 70.

Figure 5:
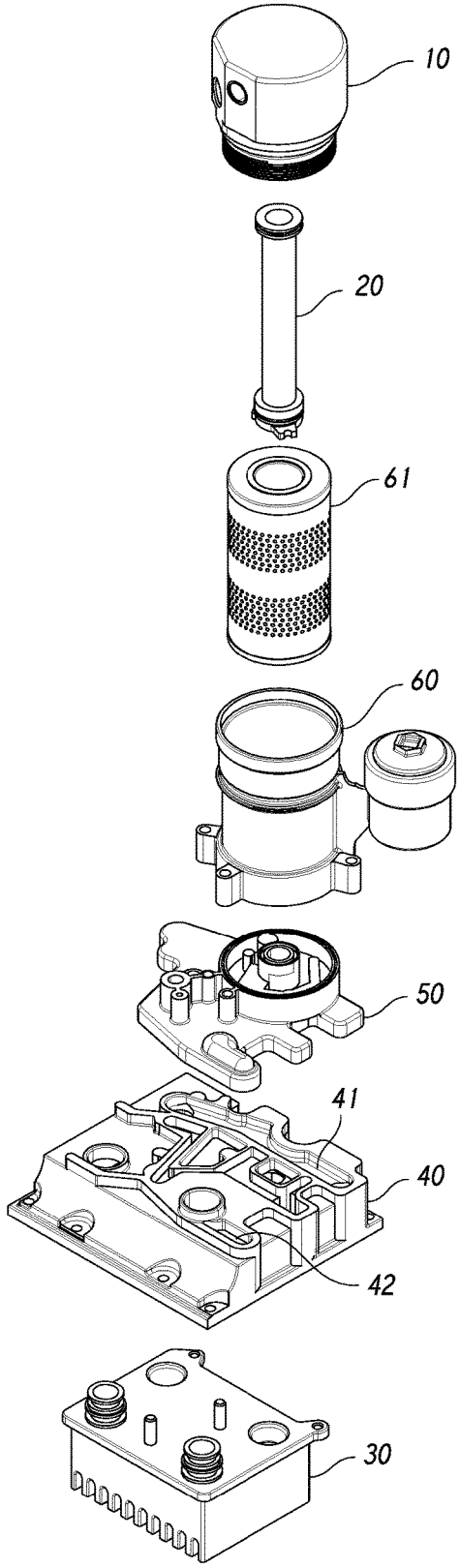
FIG. 5 is similar to FIG. 4, but without the engine block.

Referring to FIG. 5, an exploded view of an embodiment shows the oil filter 61 and the transfer tube 20. When assembled, the transfer tube 20 resides in the center of the oil filter 61. The oil filter 61 and the transfer tube 20 reside within the oil filter housing 60, and the oil filter cap 10 provides a seat for both the oil filter 61 and the transfer tube 20. The oil filter housing 60 is secured to the oil cooler housing upper 50. The oil cooler housing upper 50 is secured to the oil cooler housing lower 40. The oil cooler housing lower 40 is adjacent to the bypass manifold 30 (please see FIGS. 9 and 10). The cooler housing upper 50 and the oil cooler housing lower 40 can be OEM parts.

Figure 6:
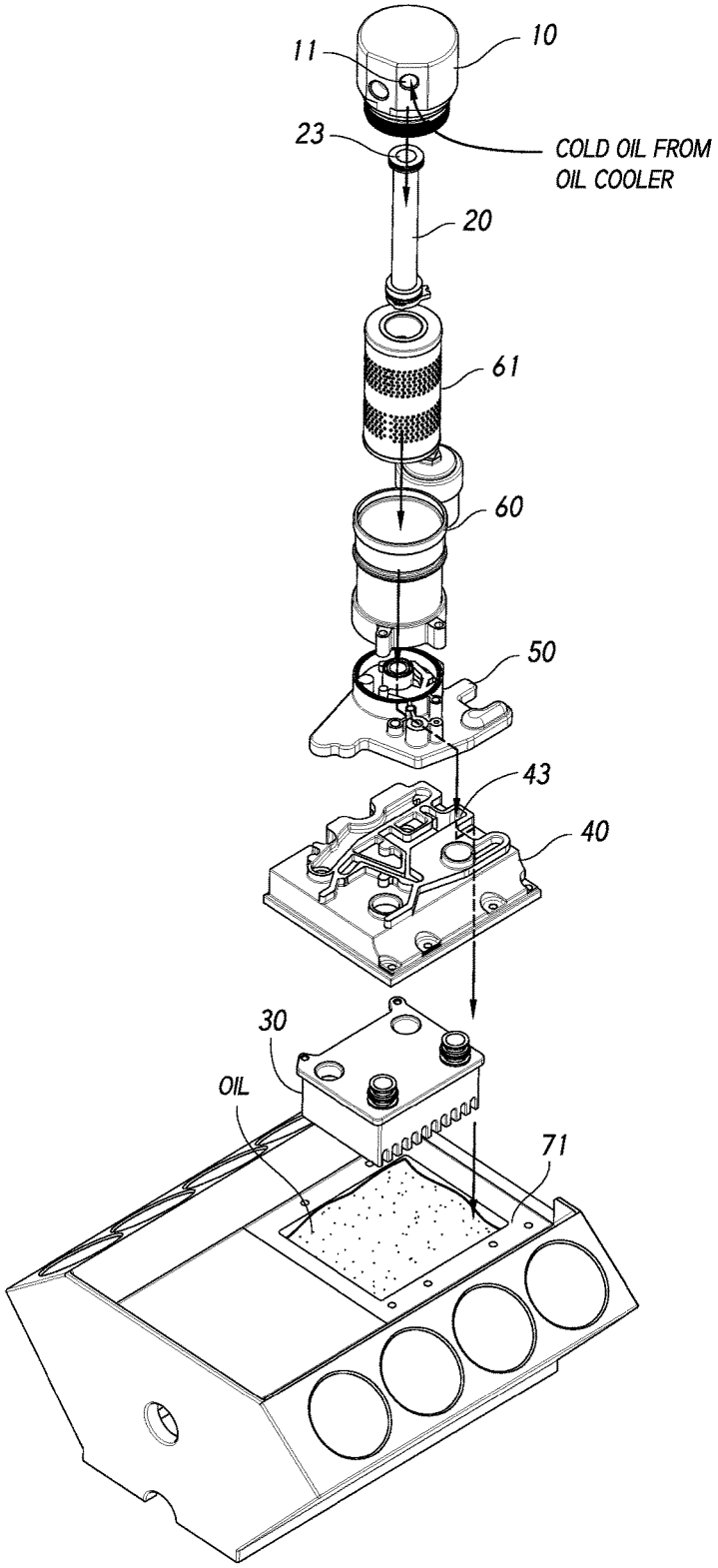
FIG. 6 is an embodiment of the invention showing the oil reservoir.

Referring to FIG. 6, the oil's return path, after it has been cooled, to the oil reservoir 71 is shown. The oil flows through the oil filter cap inlet 11, down into the transfer tube center 23, through the oil cooler housing upper 50, into the oil cooler housing lower 40, out the oil return channel 43, and into the oil reservoir 71.

Figure 7:
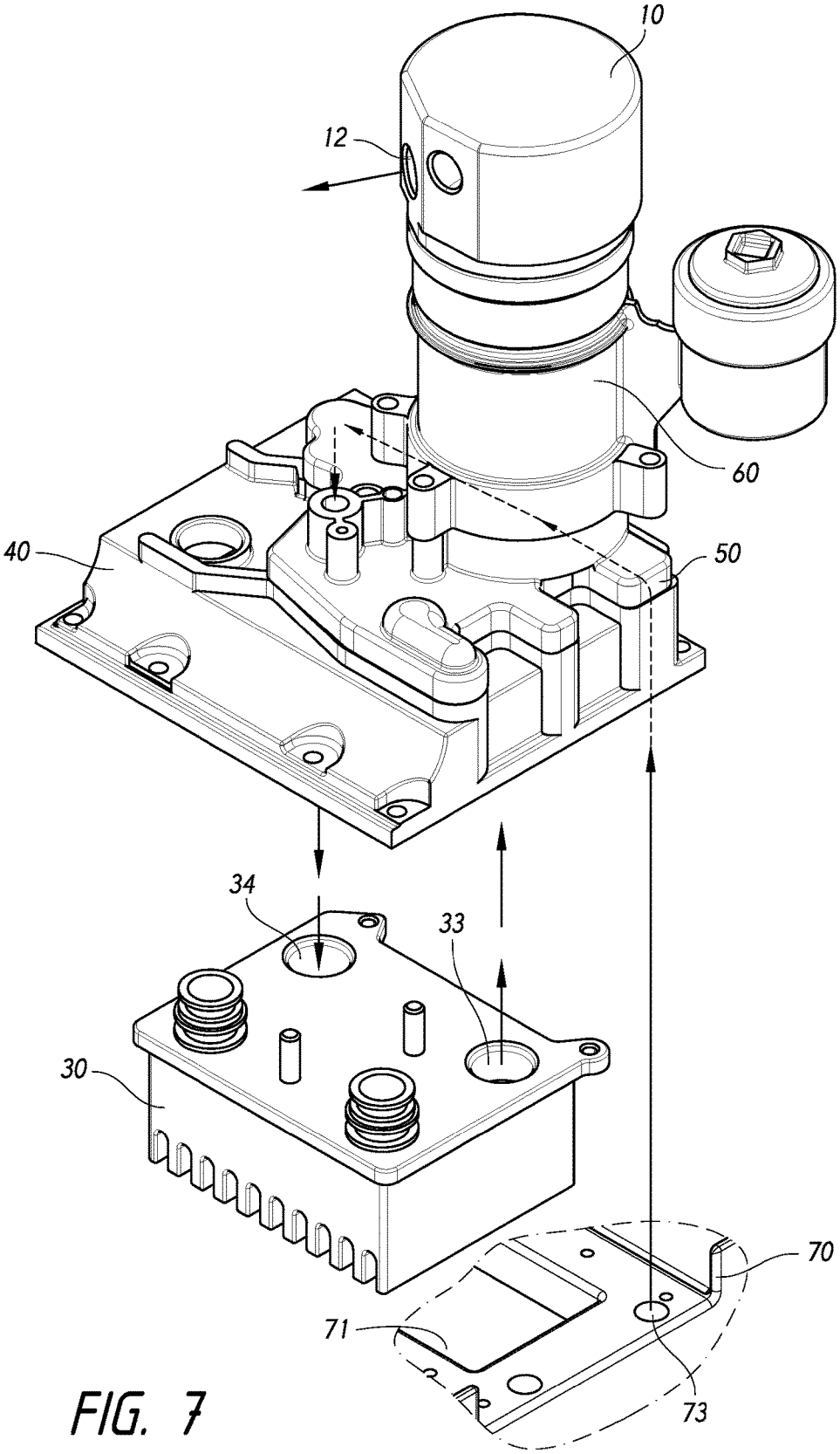
FIG. 7 is an embodiment of the invention showing the flow of oil out.

Referring to FIG. 7, the hot oil path, according to one embodiment is shown. Hot oil flows from the engine block 70 and into the oil cooler housing lower 40. The hot oil will then flow through the hot oil channel 41 and then down into the bypass manifold oil inlet 34. In the bypass manifold 30, the hot oil will flow through the oil conduit 37 and out the bypass manifold oil outlet 33. Oil will then flow through the oil cooler housing lower 40 and out the lower outlet 44. Once in the oil cooler housing upper 50, the oil will flow through a check valve 51 into the oil filter housing 60 (see FIG. 8). When oil flows into the pre-filtered space 63, the space between the oil filter housing 60 and the oil filter 61, the oil will push its way through oil filter 61 and into the post filtered space 62. The post filtered space 62 is defined by the interior of the oil filter 61 and the exterior of the transfer tube 20. The oil will then flow up though the oil filter cap 10 and out the oil filter cap outlet 12 (please see FIGS. 22-24).

Figure 8:
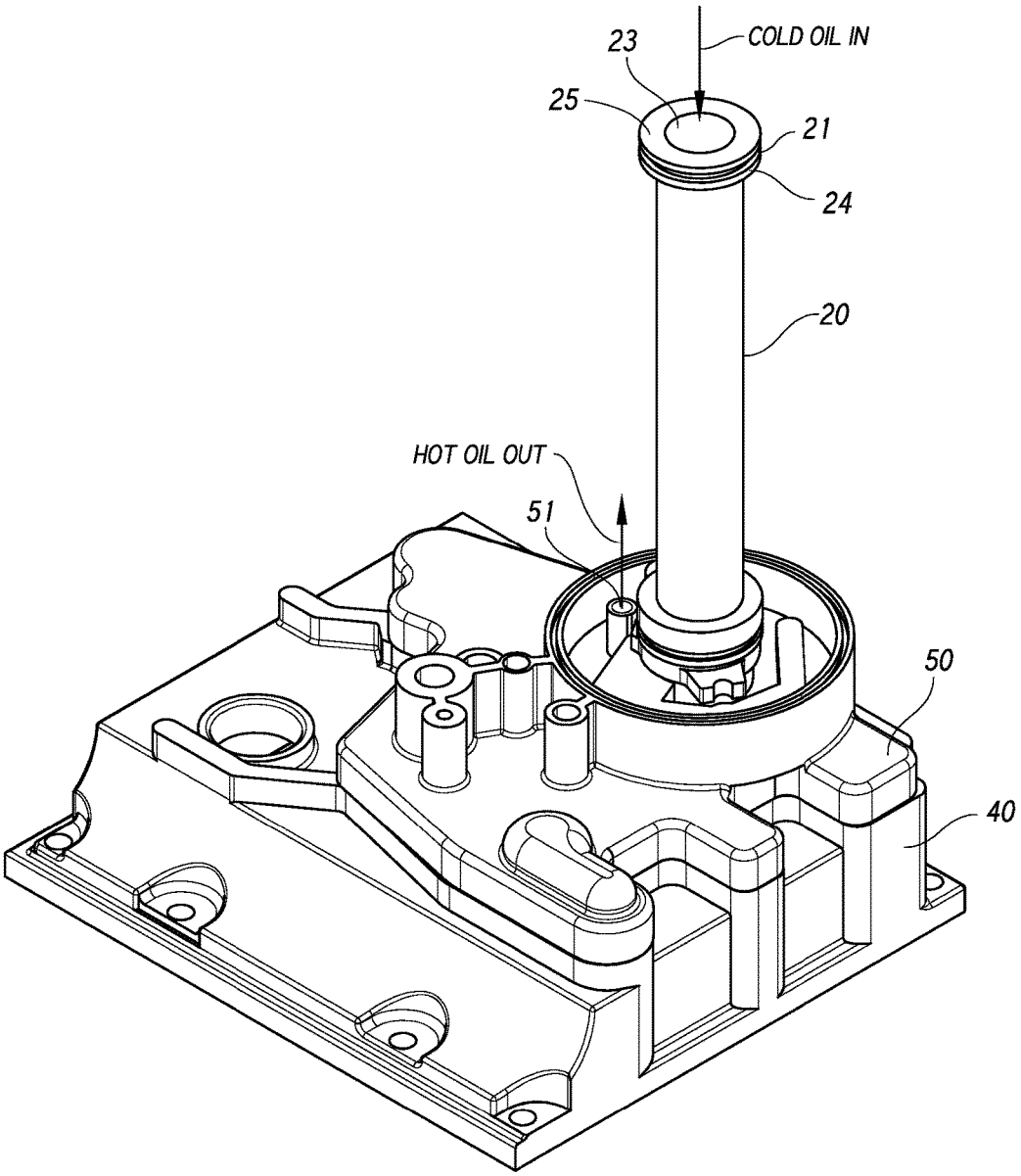
FIG. 8 is an embodiment of the invention showing the oil transfer tube.

Referring to FIG. 8, an embodiment of the oil cooler housing lower 40, the oil cooler housing upper 50 and the transfer tube 20 is shown. Hot oil will flow though the check valve 51, into the pre-filtered space 63, then move through oil filter 61, and into the post filtered space 62. The check valve 51 prevents backflow of the oil into the oil cooler housing upper. Upon return, cold oil will flow through the transfer tube center 23. The transfer tube 20 has a transfer tube seal 21 that is seated in the oil filter cap 10. Additionally, the transfer tube 20 is secured to the oil cooler housing upper. The lower end of the transfer tube 20 can mimic the lower end of the OEM oil filter stand pipe and be attached in the same manner. Thus the transfer tube 20 will prevent hot oil and cold oil from coming into contact with each other while in the oil filter housing 60. The transfer tube seal 21 can be an o-ring situated in a groove 24 located in the transfer tube flange 25.

Figure 9:
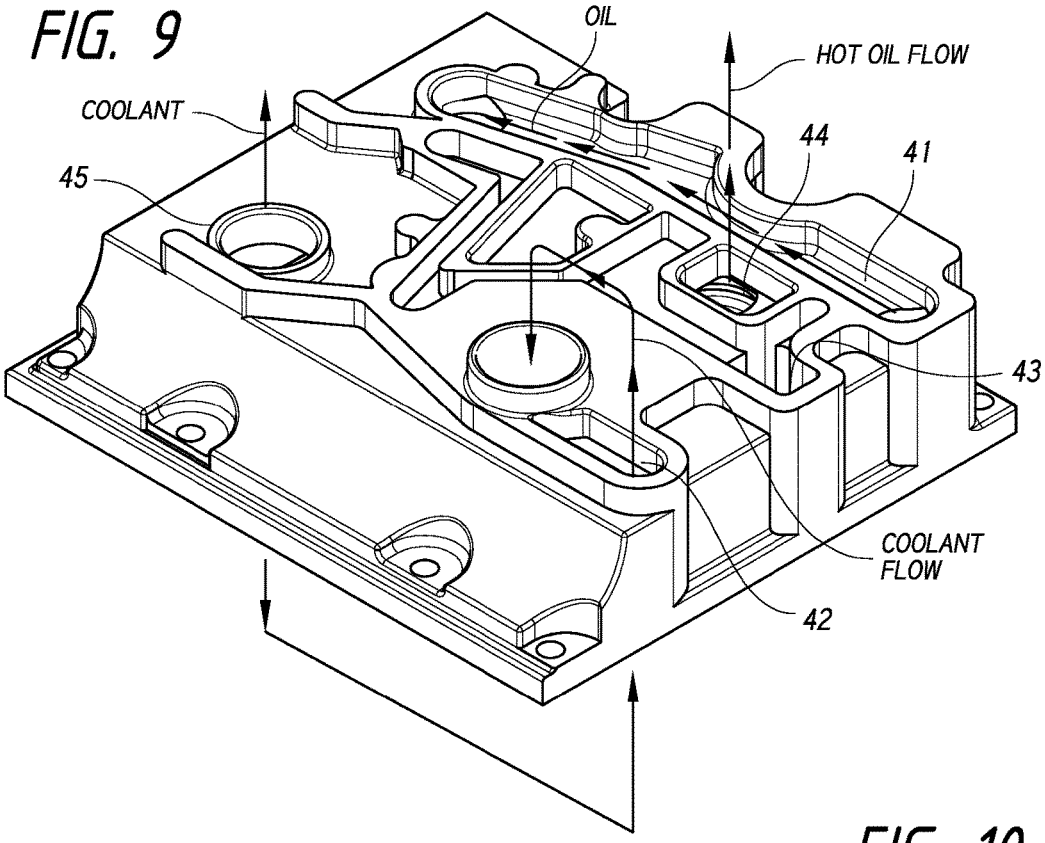
FIGS. 9 and 10 show different views of the oil cooler housing lower.
Figure 10:
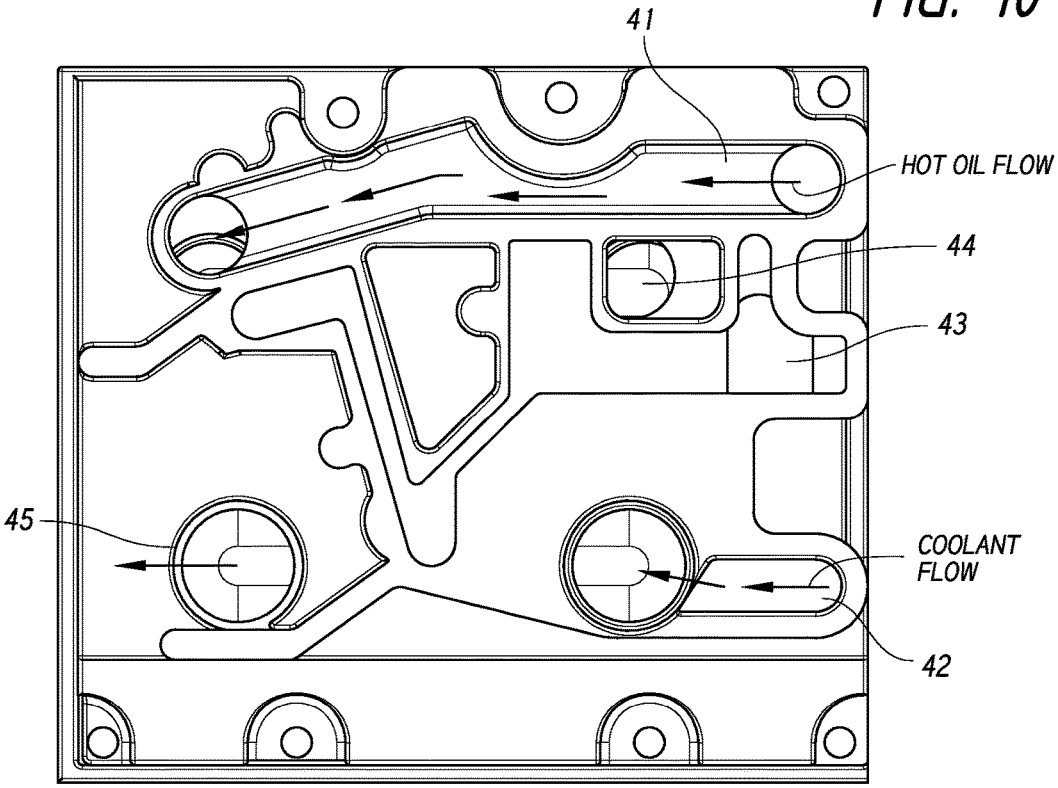

Referring to FIGS. 9 and 10, an embodiment of the oil cooler housing lower is shown. The arrows indicate the path of hot oil and cold coolant through the oil cooler housing lower 40. The hot oil flows up into and through the hot oil channel 41. The hot oil will then flow into the bypass manifold 30, then back up through the oil cooler housing lower 40, and out the lower outlet 44. The coolant flows up into and through the cold coolant channel 42, down into the bypass manifold 30, and then out though the bypass manifold coolant outlet 31 and the cold coolant outlet 45, of the oil cooler housing lower 40. It is understood that the hot oil channel 41 and the cold coolant channel 42 are sealed channels when the oil cooler housing upper 50 is secured to the oil cooler housing lower 40. It is also understood that part of the hot oil channel 41 and/or the cold coolant channel 42 can be defined by space present in the oil cooler housing upper 50.

Referring to FIGS. 11 and 12, an embodiment of the bypass manifold 30 is shown. The bypass manifold 30 can have fins 35. The bypass manifold 30 can act as a secondary oil cooler residing in the oil reservoir 71. Coolant will flow into the manifold and cool the manifold down. This will in effect cool the oil present in the oil reservoir 71. In embodiments employing fins 35, heat transfer from the oil to the coolant is aided by added surface area. It is understood that other fin designs can be employed. The bypass manifold 30 can have nipples 39 and guide posts extending from a top portion thereof. The cool coolant will flow into the bypass manifold coolant inlet 32, into the coolant chamber 36, and out the bypass manifold coolant outlet 31. In some embodiments the bypass manifold coolant inlet 32 and the bypass manifold coolant outlet 31 have nipples 39. There is also a bypass manifold oil outlet 33 and a bypass manifold oil inlet 34 that is in communication with the oil conduit 37. The bypass manifold 30 can also comprise attachment holes 38 that enable fastener(s) to secure the bypass manifold 30 to the engine block 70 and/or the oil cooler housing lower 40. In some embodiments, the bypass manifold 30 is formed from a pure molded aluminum bypass manifold blank. In other embodiments, the bypass manifold 30 comprises metal, plastic, ceramics, alloys or combinations thereof. In some embodiments, the bypass manifold 30 can be used with a VT365 diesel engine and is designed to have the same length and width as the VT365 diesel engine's oil heat exchanger.

Figure 13:
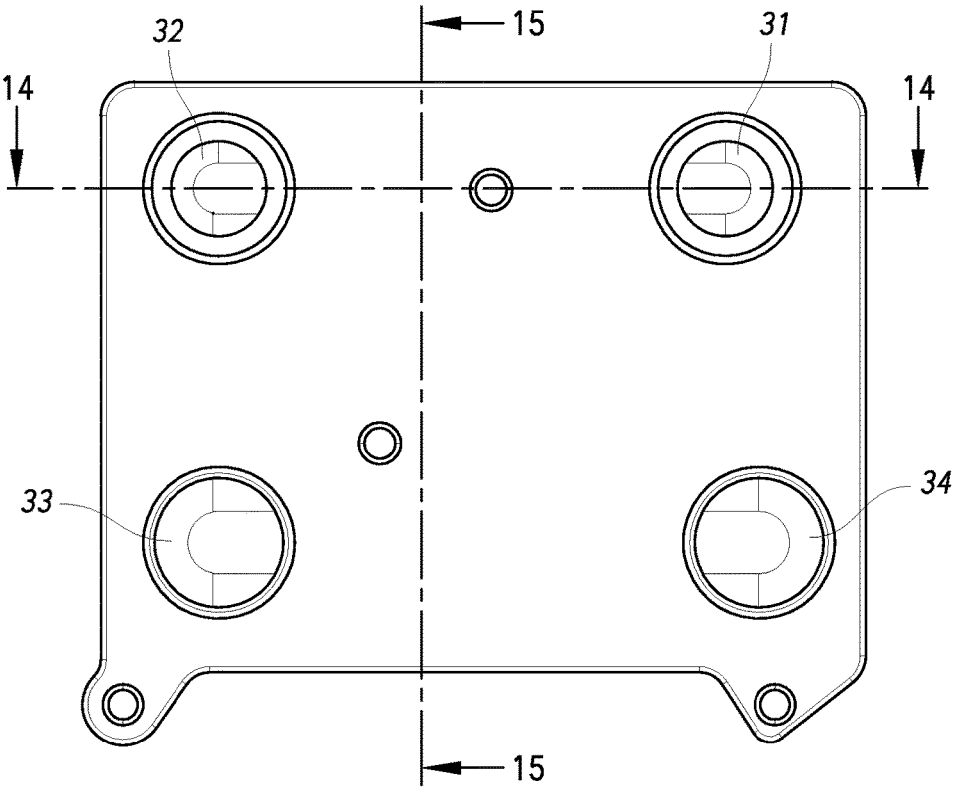
FIG. 13 shows a top view of an embodiment of the bypass manifold.
Figure 14:
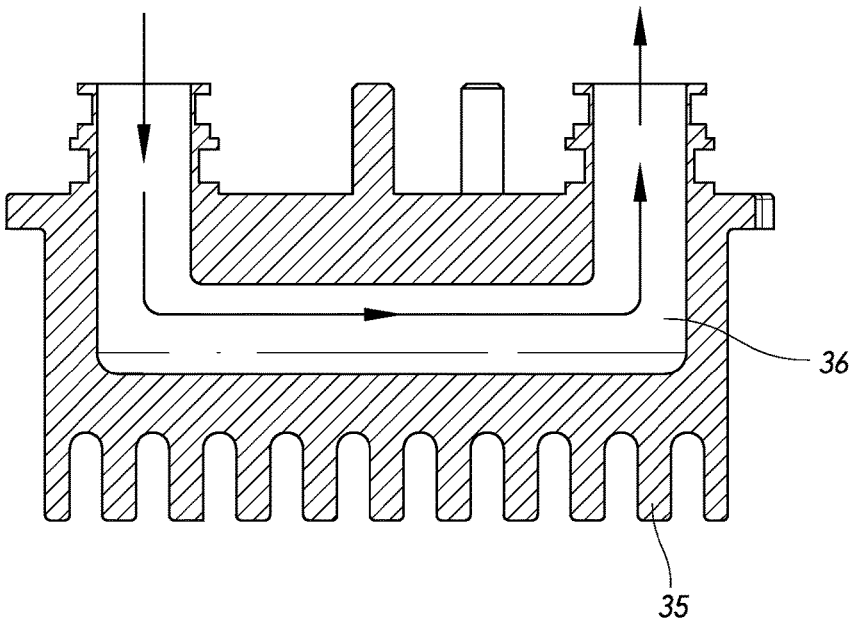
FIGS. 14-15 show cross sections of an embodiment of the bypass manifold.
Figure 15:
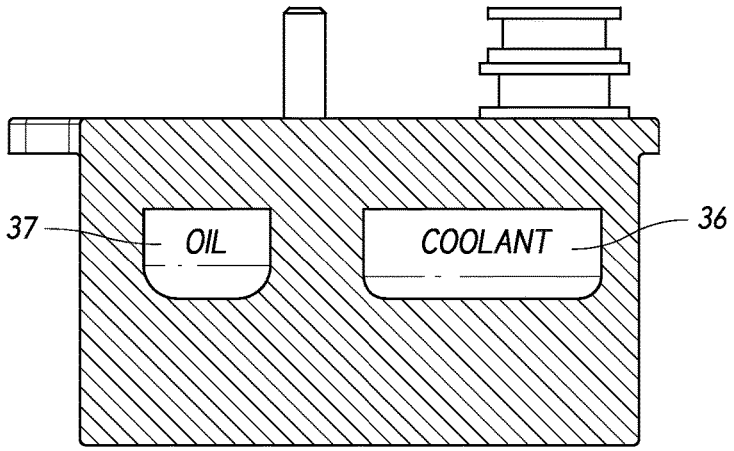
Figure 18:
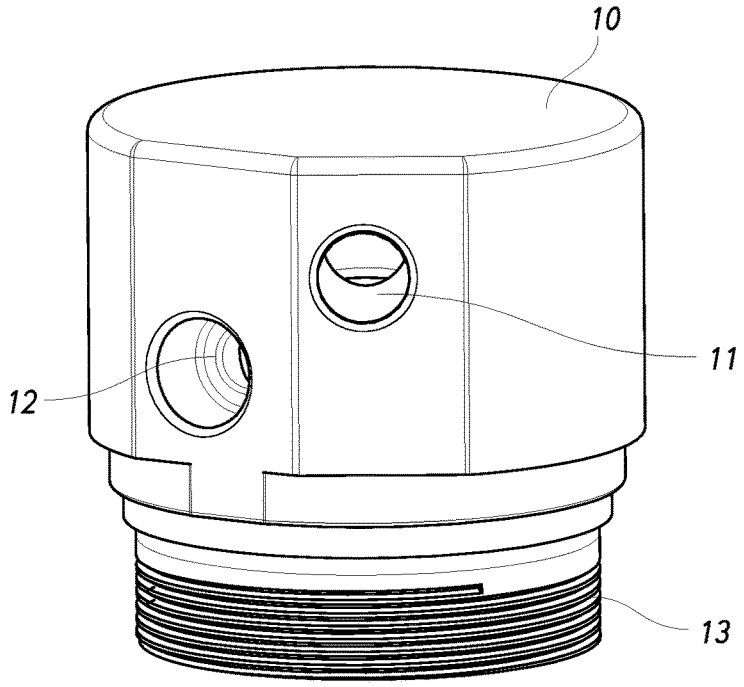
FIGS. 18-21 show an embodiment of oil filter cap.
Figure 19:
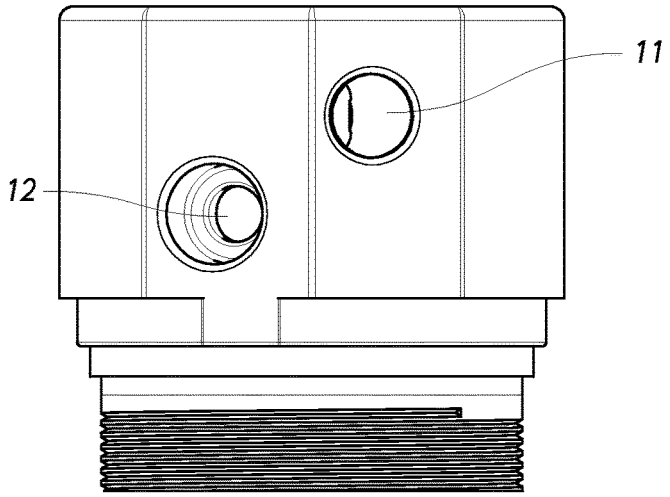

Referring to FIGS. 13-15, an embodiment of a bypass manifold 30 is shown. In some embodiments, the coolant chamber 36 is larger than the oil conduit 37. In other embodiments, the coolant chamber 36 is of equal or lesser size to the oil conduit 37. By increasing the amount of cool coolant in the bypass manifold 30, the secondary cooling effect in the oil reservoir 71 can be increased.

Referring to FIGS. 16 and 17, another embodiment of the bypass manifold 30 is shown that can be used with a MAXXFORCE 7 diesel engine. Some embodiments will have fins 35. Additionally there are no nipples 39. There is a bypass manifold coolant inlet 32 and a bypass manifold coolant outlet 31.

Figure 20:
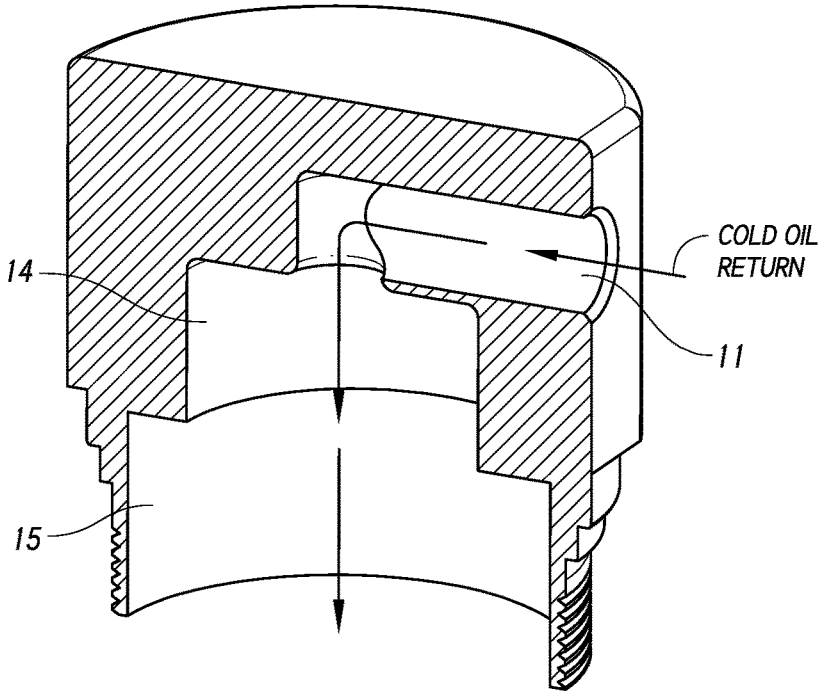
Figure 21:
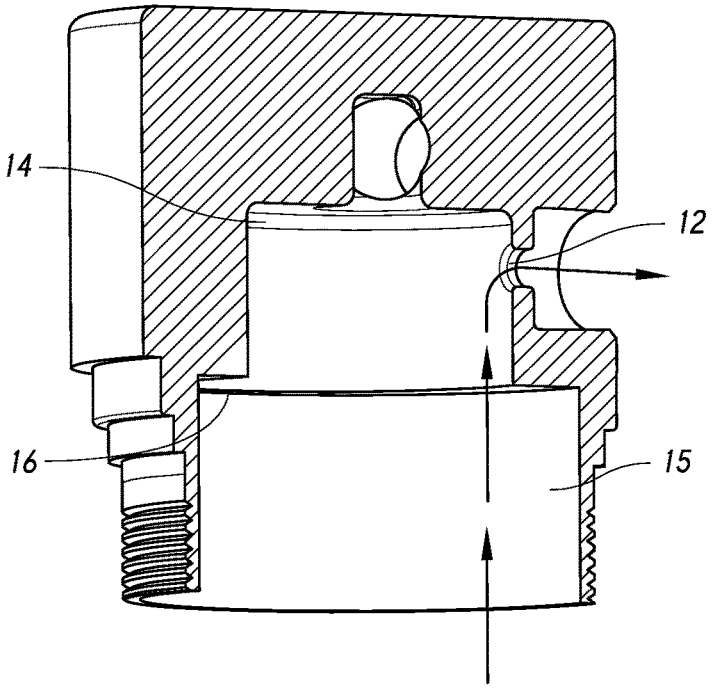

Referring to FIGS. 18-21, an embodiment of the oil filter cap is shown. The oil filter cap 10 comprises an oil filter cap inlet 11 and an oil filter cap outlet 12. When in use, the oil filter cap outlet 12 is in communication with the post filtered space 62, and the oil filter cap inlet 11 is in communication with the transfer tube center 23. The oil filter cap 10 can have a main threaded section 13 that enables the cap to be secured to the oil filter housing 60. In some embodiments, the oil filter cap inlet 11 and oil filter cap outlet 12 can have internal threads that are able to accept a treaded end of a hose. Other hose attachment means, such as nipples and/or adapters, can be used to aid the establishment of a connection. In some embodiments, a locking ring (not shown) can be employed with the main threaded section 13 to enable the orientation of the oil cap to be adjusted and secured. Referring to FIGS. 20 and 21, the internal structure of the oil filter cap 10, according to one embodiment, is shown. When an oil filter is present, the cap flange 16 will abut the top of the oil filter 61. There is also a transfer tube seat 14 that the transfer tube seal 21 will abut against to form a seal. This seal will prevent the mixing of the hot and cold oil in the oil filter housing 60. The oil filter housing 60 can be an OEM oil filter housing 60.

In some embodiments, the oil filter cap 10 is made of a sold piece of aluminum. In other embodiments, the oil filter cap 10 comprises metal, plastic, ceramic, alloys or combinations thereof. The transfer tube 20 can have an aluminum body. In other embodiments, the transfer tube 20 comprises metal, plastic, ceramic, alloys or combinations thereof.

Figure 24:
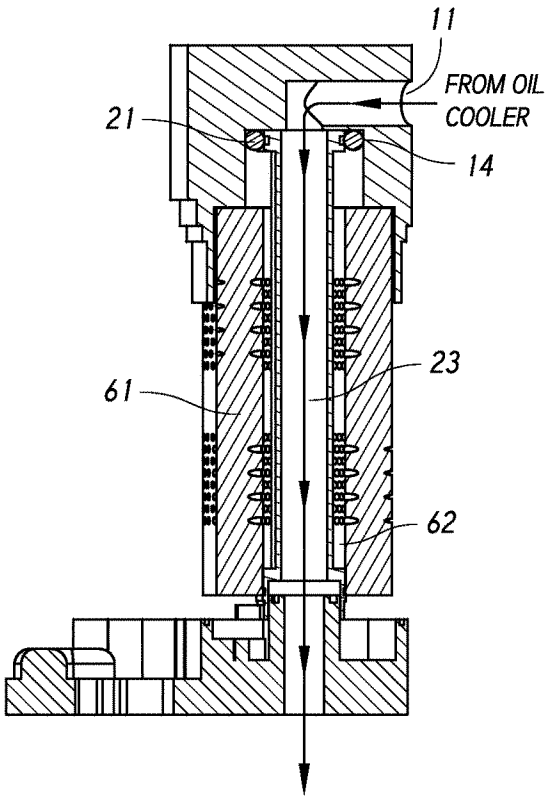
FIGS. 22-24 show different views of an embodiment of the oil filter and oil filter cap.
Figure 23:
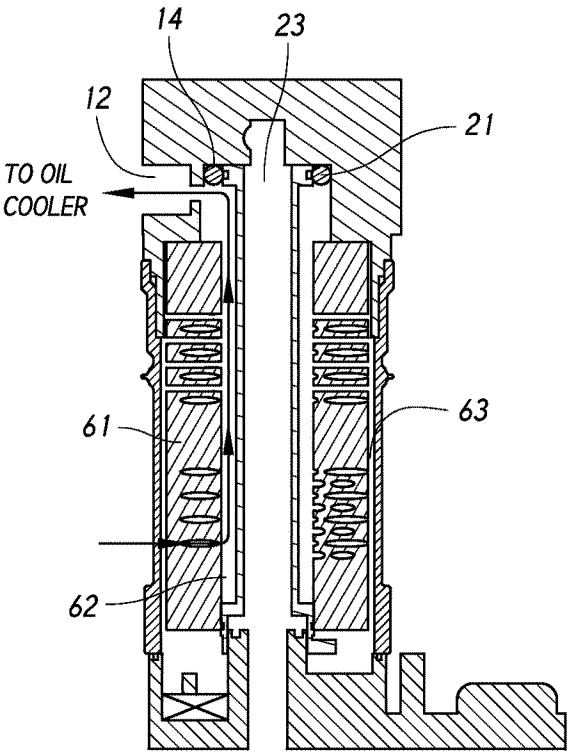
Figure 22:
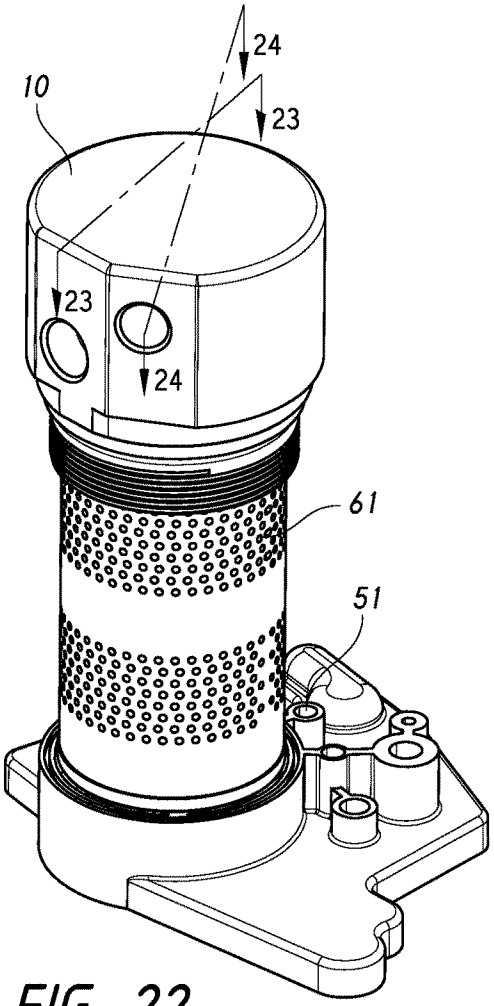
Figure 25:
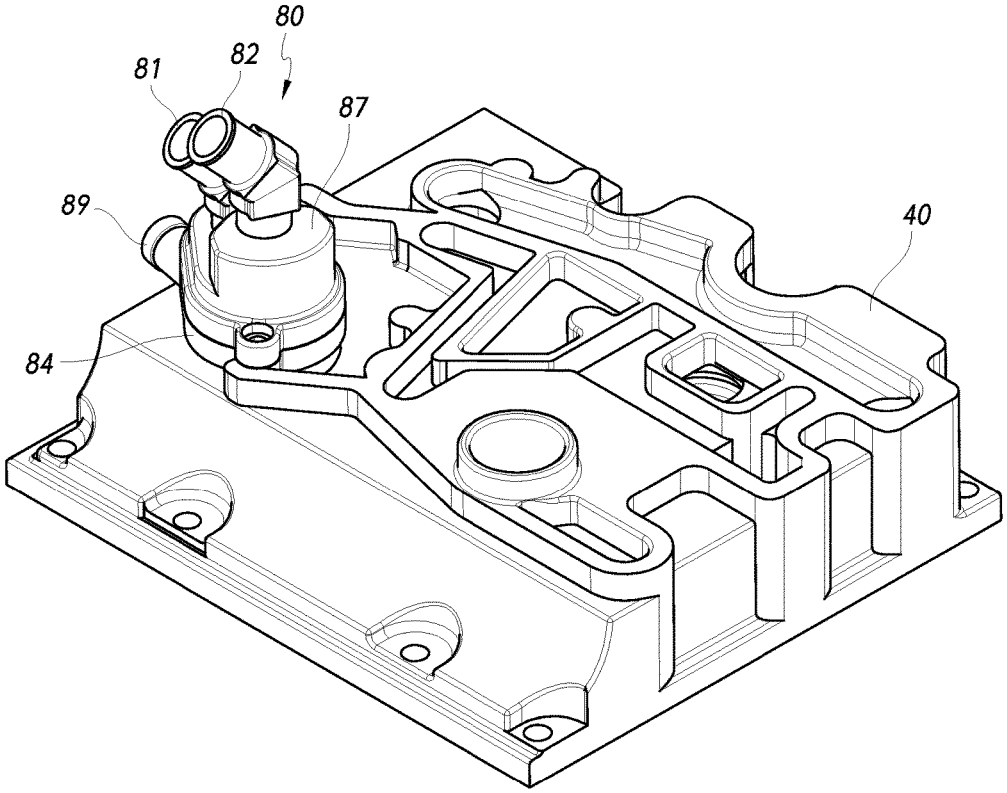
FIGS. 25-29 show different views of an embodiment of the coolant manifold.
Figure 26:
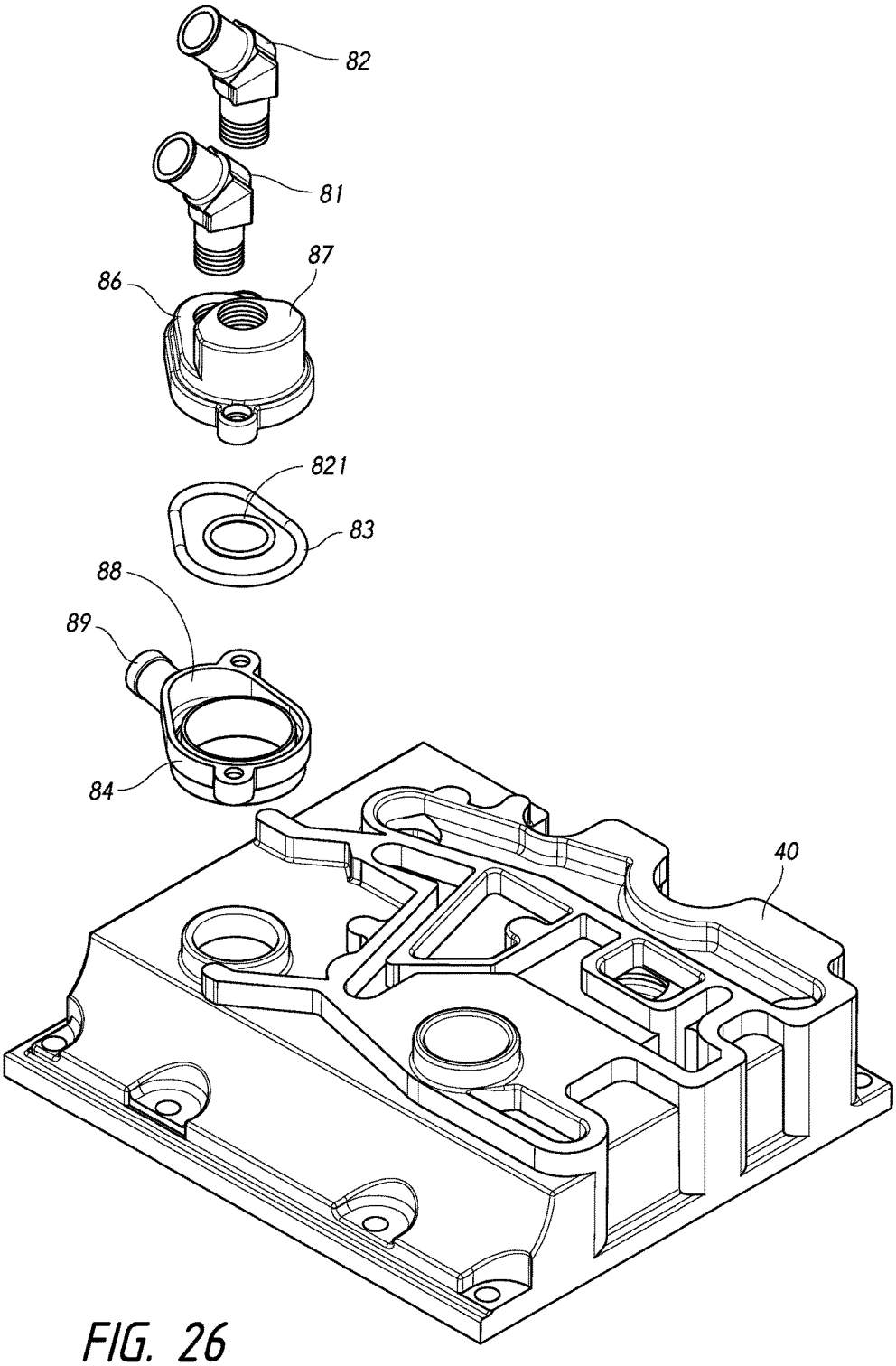

Referring to FIGS. 22-24, an embodiment of the oil filter 61, the transfer tube 20, and the oil filter cap 10 is shown. The flow path of the oil through the oil filter 61 is shown. Hot oil flows from the pre-filtered space 63, through the oil filter 61, into the post filtered space 62, and out the oil filter cap outlet 12. The seal created by the transfer tube seat 14 and the transfer tube seal 21 prevent the hot oil from entering into the transfer tube center 23. When the oil returns, the oil flows though the oil filter cap inlet 11. The oil cap inlet is in communication with the transfer tube center 23. The oil will flow thought the transfer tube center 23 and through the oil cooler housing upper 50. Eventually, when the oil flows to the oil cooler housing lower 40, it will return to the oil reservoir 71 via the oil return channel 43, of the oil cooler housing lower 40.

Referring to FIGS. 25-29, an embodiment employing a coolant manifold 80 is shown. Traditionally after coolant leaves an oil heat exchanger 100, housed in the oil reservoir 71, coolant is then routed to an exhaust gas cooler (also known as exhaust gas recirculation and EGR). The coolant manifold 80 allows the coolant to be diverted and returned before being supplied to the EGR. The coolant manifold 80 has a coolant manifold inlet 81 and a coolant manifold outlet 82. The coolant manifold outlet o-ring 821 will be secured to the coolant manifold outlet lower 84 and form a seal with the bypass manifold coolant outlet 31. In some embodiments, the coolant manifold outlet lower 84 can have a groove to seat the coolant manifold o-ring 83. In some embodiments, a coolant manifold upper 85 defines a groove that will receive the coolant manifold outlet o-ring 821. The coolant manifold outlet o-ring 821 can help create a seal so that there is no mixing between the coolant manifold outlet 82 and the coolant manifold lower 84. Thus, coolant will flow right into the coolant manifold outlet 82 from the oil heat exchanger 100 or the bypass manifold 30. Then the coolant can flow to a desired location. Once the coolant is returned, it will flow through the coolant manifold inlet 81, into the coolant manifold lower receiving space 88, and then it will flow though the coolant manifold lower outlet 89. In some embodiments, the coolant will flow out of the coolant manifold lower outlet 89 into the EGR cooler. In some embodiments, when the coolant exits via the coolant manifold outlet 82, the coolant flows to an oil cooler where it will cool the oil and return via the coolant manifold inlet 81. In some embodiments the coolant manifold upper 85 is designed to fit an OEM coolant manifold lower 84.

Figure 27:
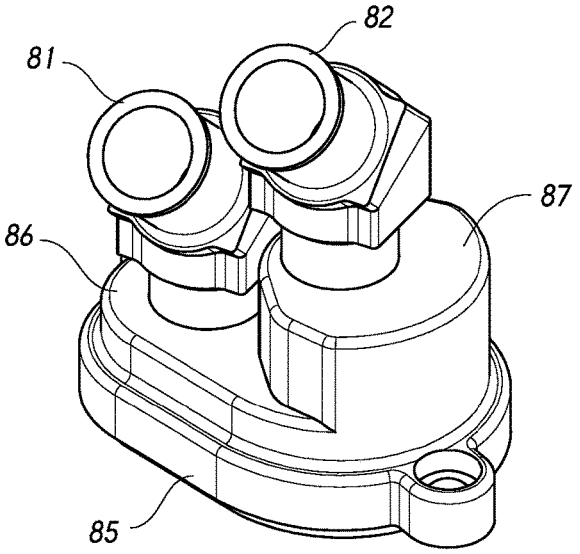
Figure 28:
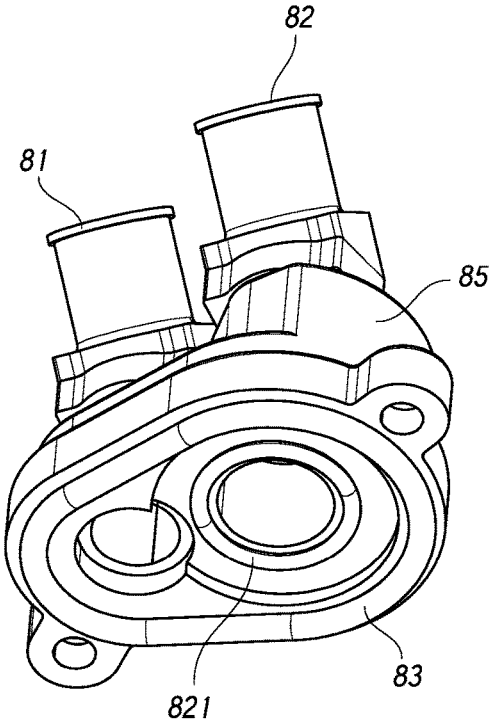
Figure 29:
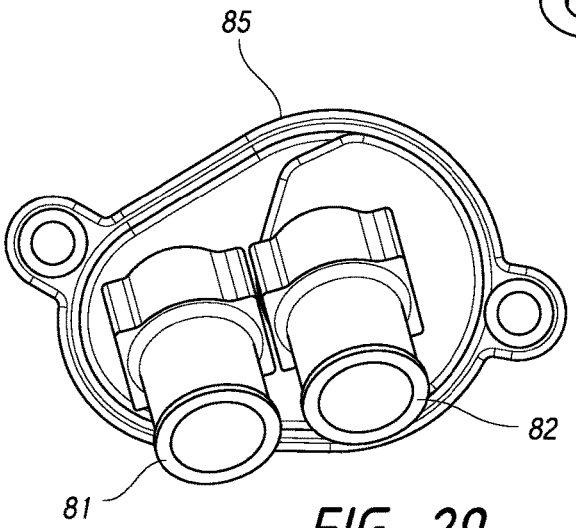

Referring to FIGS. 27-29, different views of an embodiment of coolant manifold upper 85 with the coolant manifold outlet 82 and the coolant manifold inlet 81. The coolant manifold upper 85 has an inlet receiving portion 86 and an outlet receiving portion 87. In some embodiments, the outlet receiving portion 87 is raised relative to the inlet receiving portion 86. The coolant manifold upper 85 can have a shape that can corresponds to any coolant manifold lower 84. A coolant manifold 80 seal will act to seal the coolant manifold upper 85 and the coolant manifold lower 84. The coolant manifold outlet 82 and the coolant manifold inlet 81 can define an angle. The angle need not be the same for both of them. In some embodiments, the angle is set to about forty-five degrees. In some embodiments, the coolant manifold inlet 81 and the coolant manifold outlet 82 are threadedly engaged with the coolant manifold upper 85.

Figure 30:
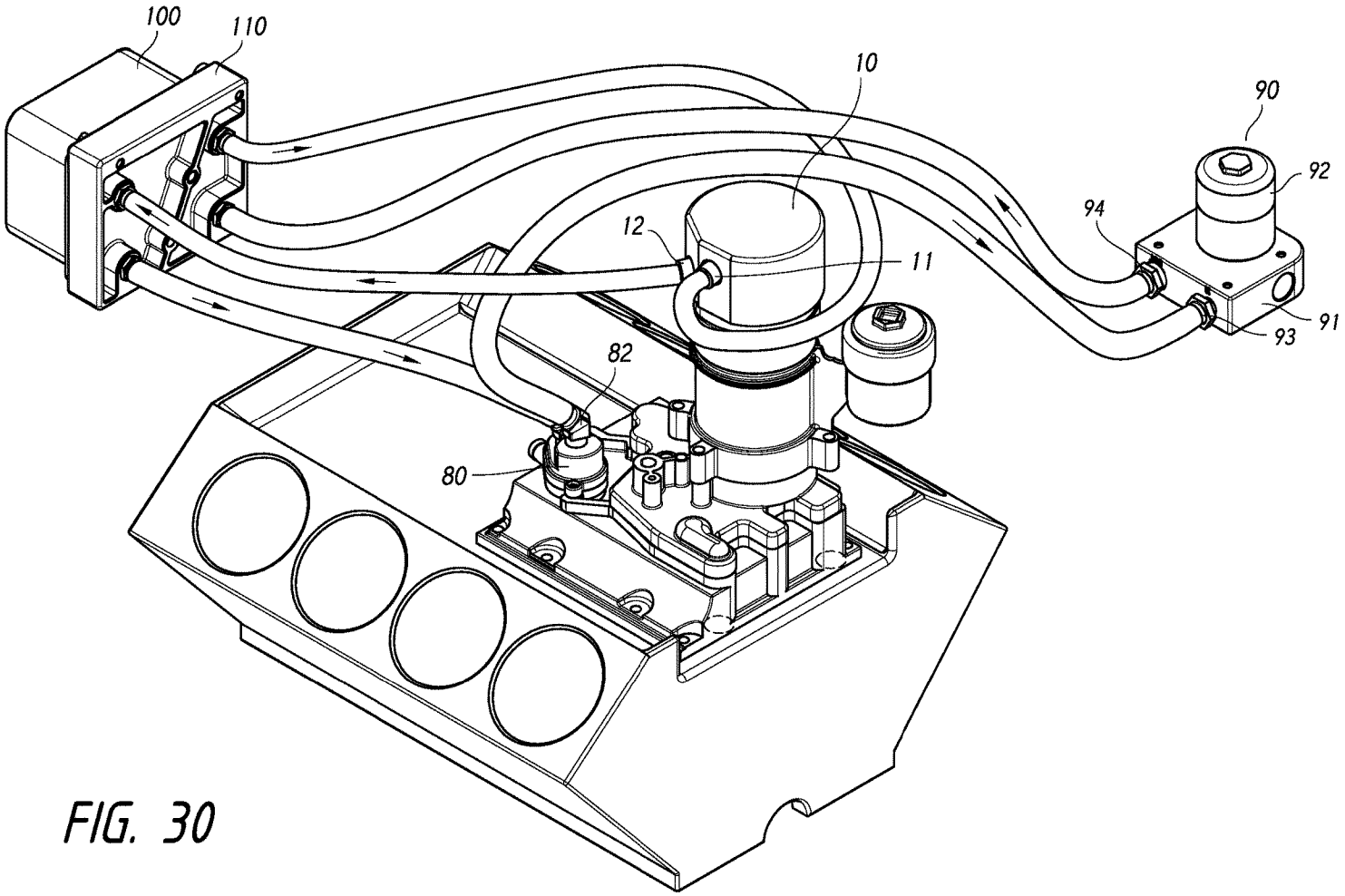
FIG. 30 shows an embodiment of the invention having coolant cooled oil cooler, a coolant filter housing, a coolant manifold, and an adapter plate.

Referring to FIG. 30, an embodiment of a cooling system is shown. The oil heat exchanger 100 is a coolant cooled heat exchanger. In some embodiments, the oil heat exchanger 100 is the OEM heat exchanger that has been removed from the oil reservoir 71 and replaced by the bypass manifold 30. The OEM oil heat exchanger 100 is mounted and is in communication with the oil filter cap 10 via conduits. In some embodiments, the conduits are hoses. It is understood that the oil heat exchanger 100 need not be the OEM oil heat exchanger 100. It can be a replacement oil heat exchanger 100 or a different oil heat exchanger 100. Oil will flow out the oil filter cap outlet 12, through the adapter plate oil inlet 114, and into the oil heat exchanger 100 via the oil heat exchanger oil inlet 101. The oil is then cooled in the oil heat exchanger 100 and exits via the oil heat exchanger oil outlet 102. Oil will then flow though the adapter plate oil outlet 113 and into the oil filter cap inlet 11.

In some embodiments, a coolant filter housing 90 is employed. Coolant will flow from the coolant manifold outlet 82 to the coolant filter inlet 93. Within the coolant filter housing 90, the coolant is filtered and then exits via the coolant filter outlet 94. The coolant will then flow through the adapter plate coolant inlet 112 and into the oil heat exchanger 100 via the oil heat exchanger coolant inlet 103. After the coolant acts to cool the oil, it flows out the oil heat exchanger coolant outlet 104 and into the coolant manifold inlet 81. The coolant filter housing 90 can be secured in the engine compartment with a mounting bracket.

Referring to FIGS. 41-45, an embodiment of the coolant filter housing upper 92, the coolant filter spring 923, coolant filter 921, and the coolant filter base plate 922 is shown. The coolant filter spring abuts the coolant filter housing upper 92 and biases the coolant filter 921 toward the coolant filter base plate 922. This helps the coolant filter 921 maintain proper positioning in the coolant filter housing upper 92. The coolant filter 921 will act to filter the coolant before it exits the coolant filter housing 90. Given the corrosive nature of the coolant, the coolant filter should be resistant to corrosion. In some embodiments, the coolant filter comprises stainless steel. The coolant also tends to flow at a high rate though the coolant system. Thus in some embodiments, the coolant filter 921 is a high flow filter.

Figure 31:
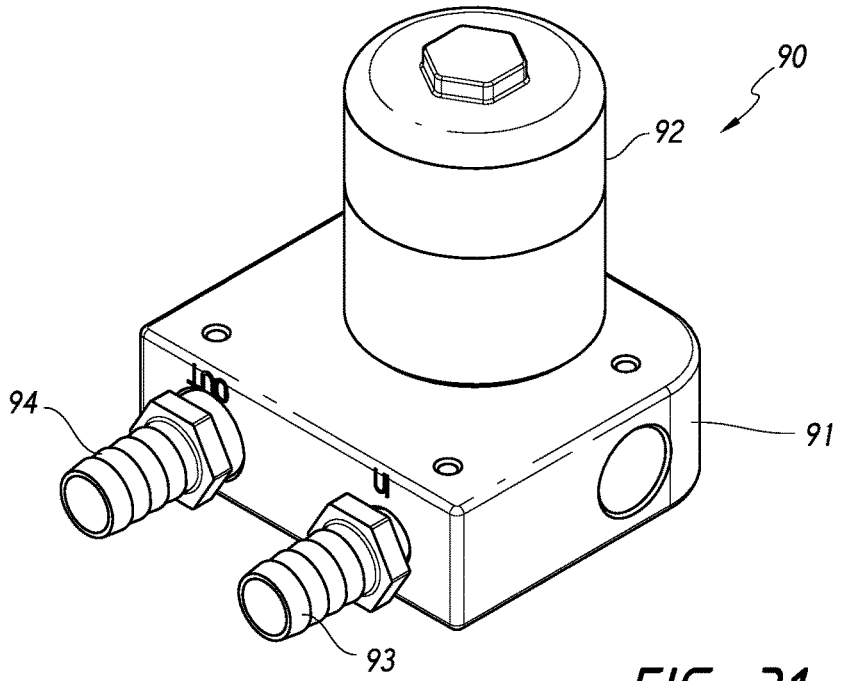
FIGS. 31 and 32 show different views of an embodiment of the coolant filter housing.
Figure 32:
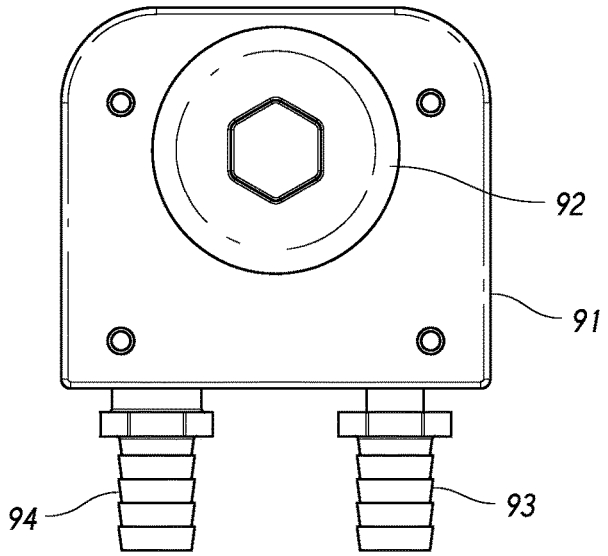

Referring to FIGS. 31-32, an embodiment of the coolant filter housing 90 is shown. The coolant filter housing 90 comprises a coolant filter upper 92 and a coolant filter lower 91. The coolant filter housing lower 91 comprises a coolant filter inlet 93 and a coolant filter outlet 94. The coolant filter upper 92 is able to be secured to the coolant filter lower 91. In some embodiments, the coolant filter upper 92 and the coolant filter lower 91 are engaged by corresponding threads. The coolant filter upper 92 can house a disposable or reusable filter.

Figure 33:
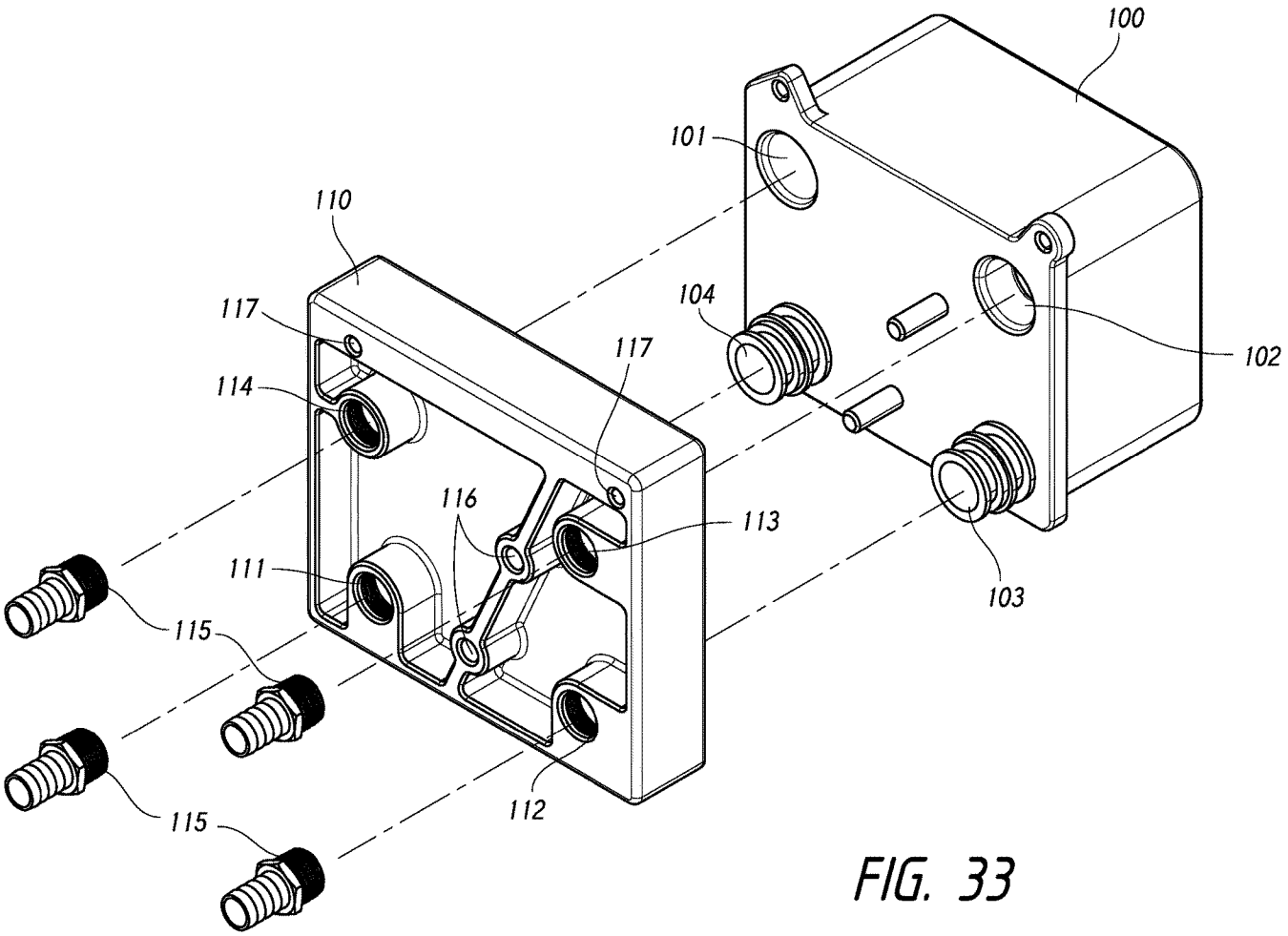
FIGS. 33-35 show different views of an embodiment of the adapter plate.
Figure 35:
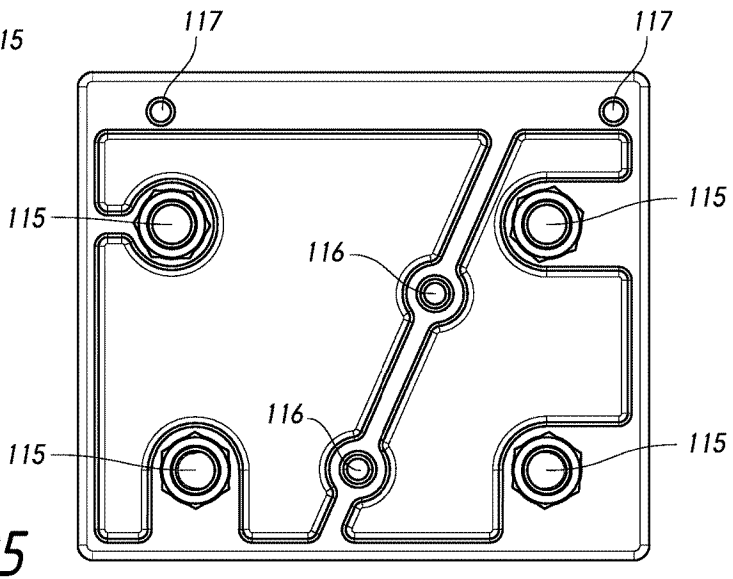
Figure 34:
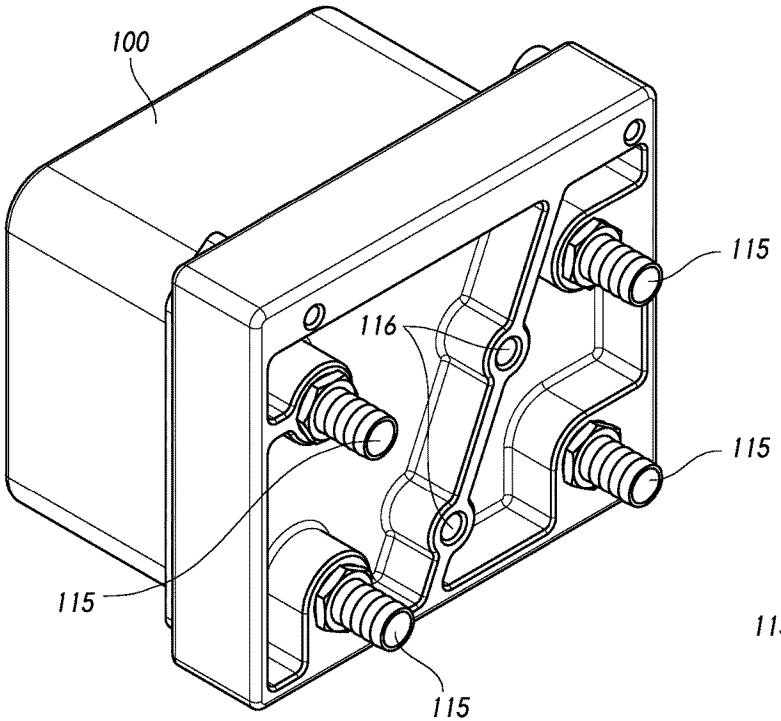

An embodiment of the adapter plate 110, is shown in FIGS. 33-35. The adapter plate 110 comprises an adapter plate coolant outlet 111, adapter plate coolant inlet 112, adapter plate oil outlet 113, and adapter plate oil inlet 114. The adapter plate 110 can also define some post holes to accommodate the guide post(s) of the oil heat exchanger 100, if present. In some embodiments, the adapter plate inlets 112, 114 and adapter plate outlets 111, 113 have internal threads that can correspond to threaded ends of hoses. In other embodiments, adapter plate conduit attachments 115 are threaded onto, permanently attached, or integral with the adapter plate 110. The adapter plate conduit attachments 115 can be treaded or have a barbed fittings. In some embodiments, the adapter plate 110 comprises adapter plate attachment holes 117 that enable the mounting of the adapter plate 110 to the OEM oil heat exchanger 100.

Referring to FIG. 36, an embodiment is shown having an OEM oil heat exchanger 100 adjacent to an adapter plate 110. Conduits connect the oil filter cap outlet 12 with the oil heat exchanger oil outlet 102, the oil filter cap outlet 12 with the oil heat exchanger oil inlet 101, and the coolant filter outlet 94 with the oil heat exchanger coolant inlet 103. The coolant filter inlet 93 is connected to a coolant source, and oil heat exchanger coolant outlet 104 sends the coolant on through the coolant system.

Figure 37:
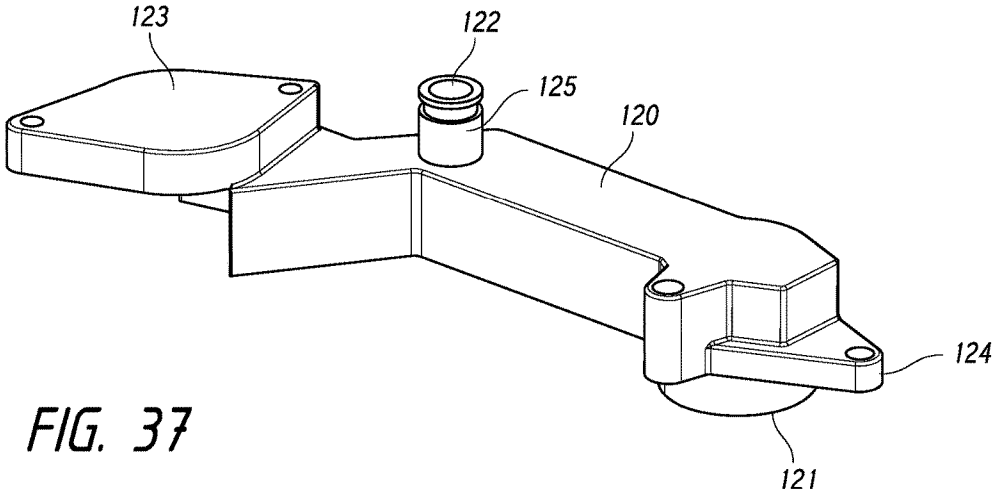
FIGS. 37 and 38 show an embodiment of the delete.
Figure 38:
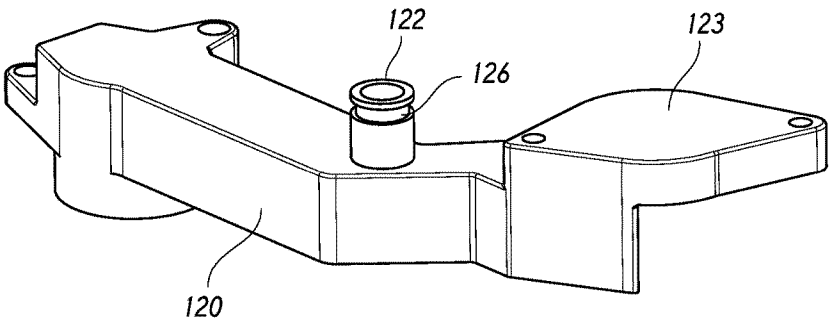

Additionally in FIGS. 36-38, an embodiment of a delete 120 is shown. However, current EGR systems in use do not fare well under very strenuous activity, like off road use. The EGR valve is susceptible to carbon buildup. There are current delete kits on the market that require flanges to be machined and attached to a U-shape hose or tube by welding or threading the plumbing into the flange, that attaches to the intake manifold. In addition, the current kits on the market require a hose and hose clamps, to secure the U shape hose/tube to the factory oil heat exchanger water jacket housing, and they require the use of the factory water jacket housing. The delete 120 can be constructed of a single piece of material. The material can be aluminum, plastic, stainless steel, or other materials that will not rust due to exposure to the coolant. The ability to use a single piece of material eliminates several manufacturing processes, which include welding or machining threads or a flange (to attach the U shape tube), polishing (for aesthetics), and bending a steel. The delete's 120 single piece design it allows the oil cooler water jacket to be eliminated for a cost savings. It will also prevent oil cooler water jacket damage due to corrosion on the nipple of the housing, and thus preventing costly replacement with a new unit. The delete 120 also eliminates several potential points of failure such as the thread or welded section of conventional delete kits. Additionally the delete 120 eliminates the use of a hose and a hose clamp to attach a conventional EGR delete tube to the oil cooler water jacket housing.

The delete 120 comprises of a delete body, a delete coolant inlet 121, a delete coolant outlet 122, and a delete support flange 123. There is an internal conduit that attaches the delete coolant inlet 121 with the delete coolant outlet 122. The delete support flange 123 will attach to the intake manifold via fasteners. The delete support flange 123 will also serve will mimic the EGR cooler intake so as to for a seal with the intake manifold. To install, the OEM coolant manifold lower 84 is removed from the oil cooler housing lower 40, and the delete attachment 124 is secured in its place. The delete coolant inlet 121 has an internal diameter that enables it to be at least partially placed over cold coolant outlet 45. The delete 120 will direct all of the coolant through the internal conduit to the delete coolant outlet 122. Some embodiments the delete coolant outlet 122 will have a nipple that easily enables a conduit to be attached. In some embodiments a delete collar 126 is present.

Figure 48:
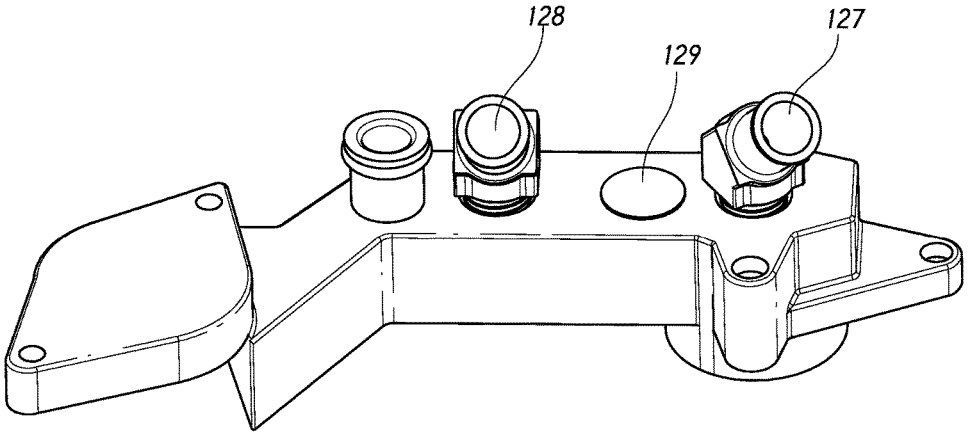
FIGS. 48-49 shows an embodiment of an delete.
Figure 49:
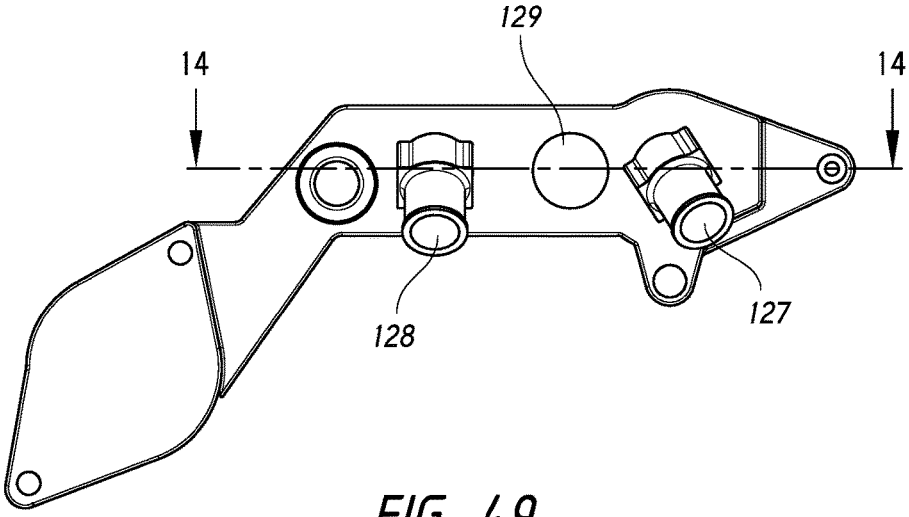
Figure 50:
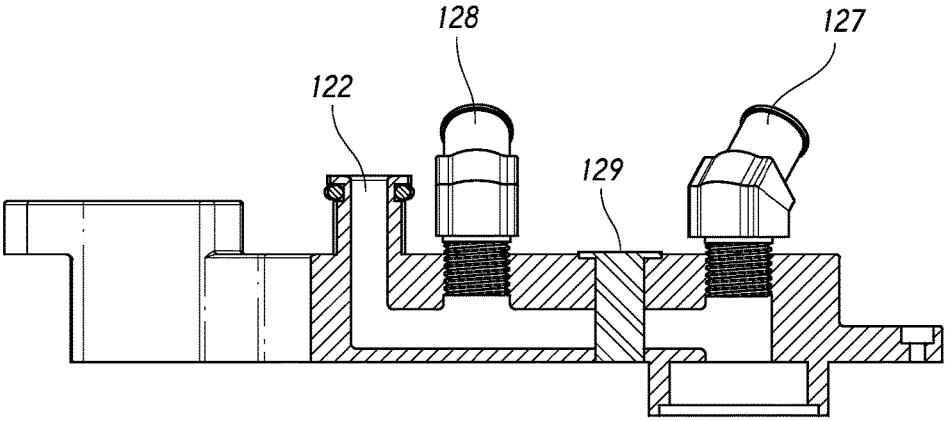
FIG. 50 shows a cross section of an delete shown in FIG. 49.
Figure 51:
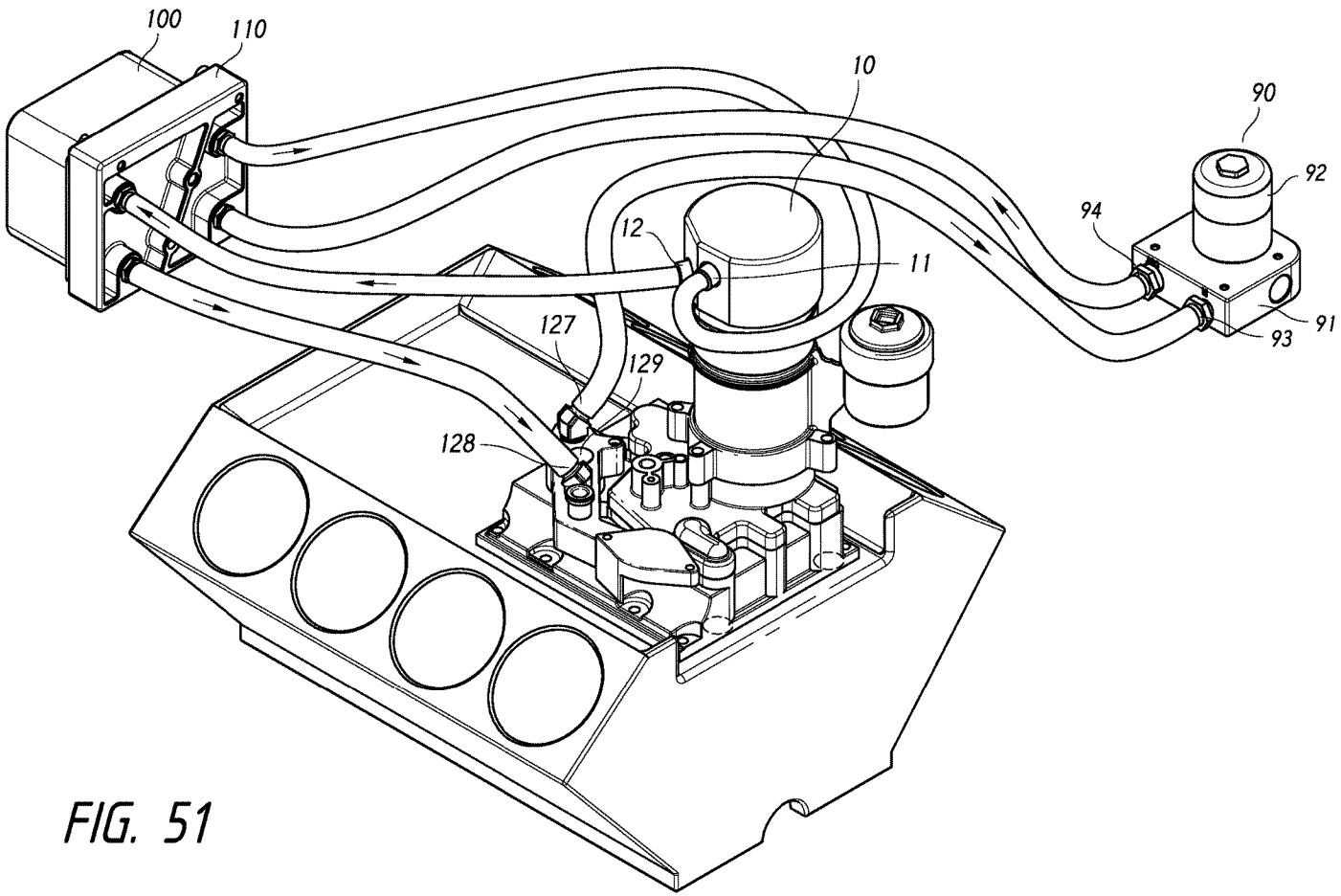
FIG. 51 shows an embodiment that is similar to FIG. 30, but using an embodiment of an delete.
Figure 52:
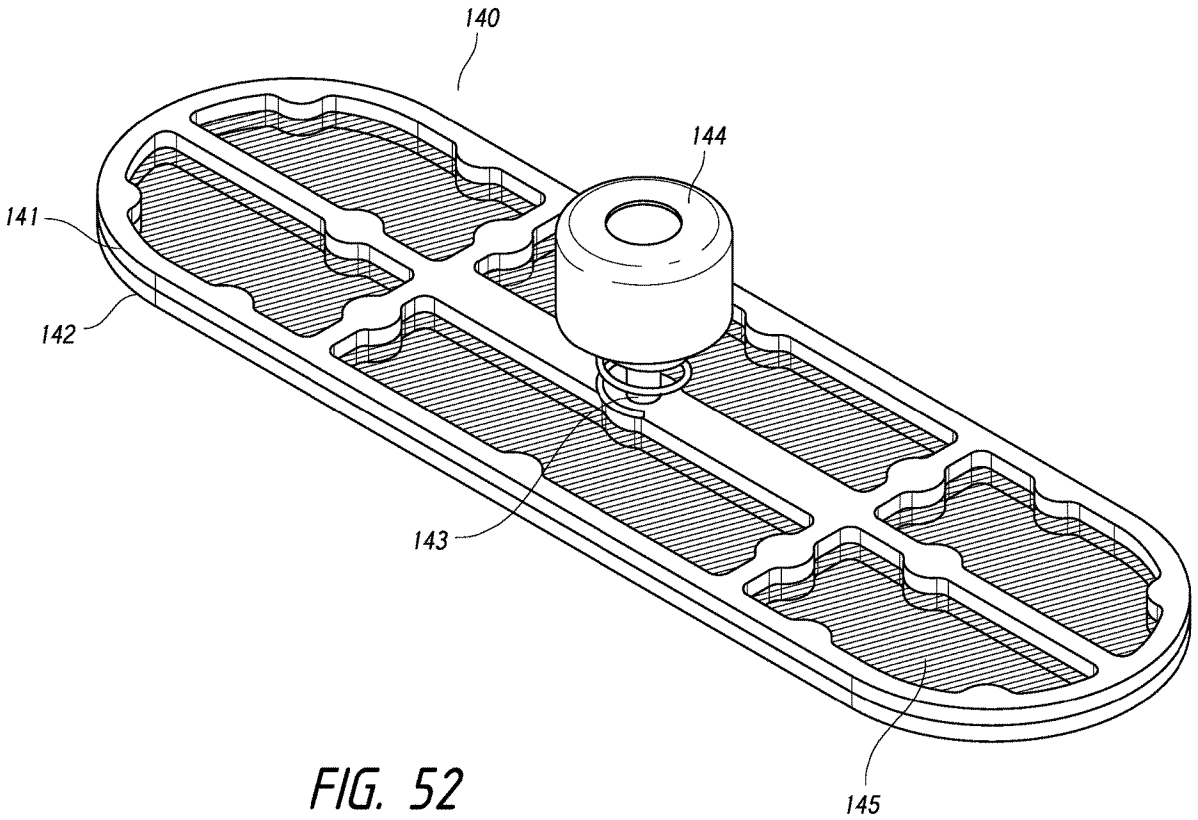
FIG. 52 shows an embodiment of the high pressure filter screen.
Figure 53:
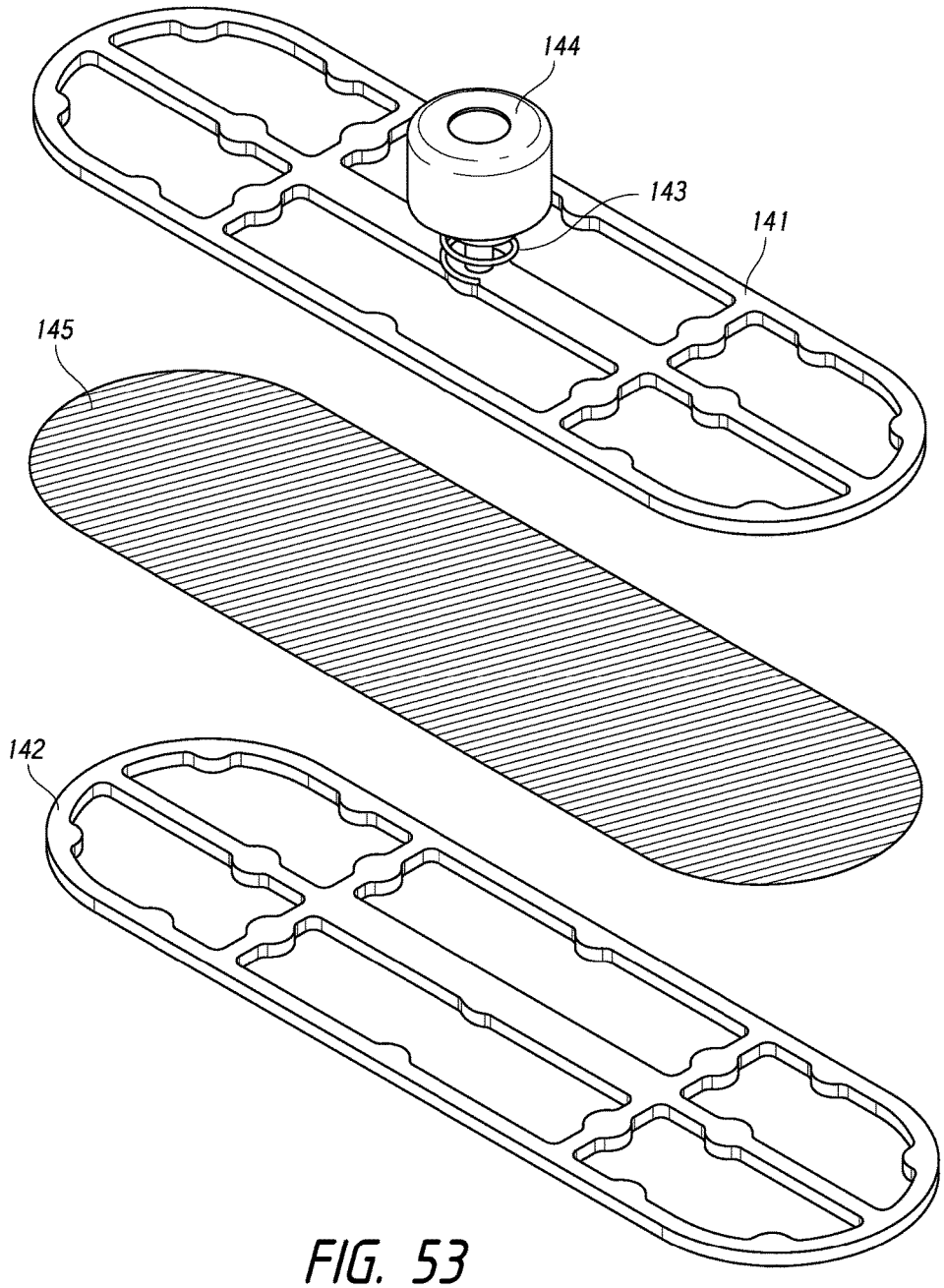
FIG. 53 shows an exploded embodiment of the high pressure filter screen.

Referring to FIGS. 48-50, another embodiment of the delete 120 is shown. The delete comprises a delete body, a delete manifold out 127, a delete return 128, and a delete partition 129. Coolant will flow into the delete 120 then out the delete manifold out 127. The coolant, in some embodiments, will flow to the to the coolant filter housing 90 and back from the coolant filter housing 90 into the delete return 128. In other embodiments, the coolant will return from the oil heat exchanger 100. Once the coolant returns via the delete return 128, it will flow out the delete coolant outlet 122. The delete partition 129 is an internal barrier that prevents the coolant that has entered the delete coolant inlet 121 from direct communication with the delete return 128. The delete return 128 and the delete manifold out 127 can be threadedly engaged with the delete body and can be angled. In other embodiments, the delete return 128 and the delete manifold out 127 are integral with the delete body. The delete partition 129 can be integrally formed in the delete body. In some embodiments, the delete partition 129 is a plug that is inserted into a bore that extends through to a passageway that extends from the delete coolant inlet 121 and the delete coolant outlet 122. One or more of the delete coolant inlet 121, the delete outlet nipple 125, the delete manifold out 127, the delete return 128 can be elements that are engaged with the delete 120, or one or more can be integrally formed with the delete 120.

Figure 40:
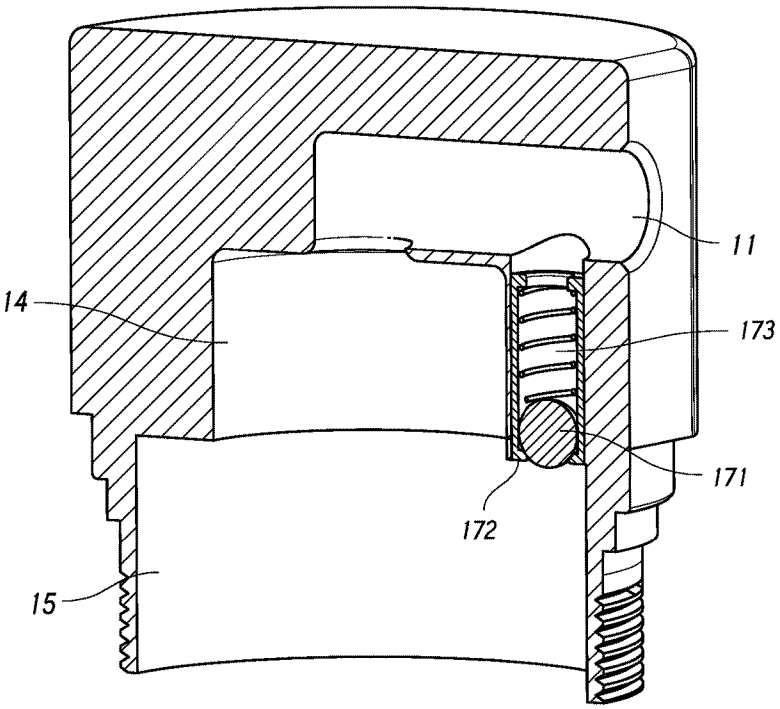
FIGS. 39 and 40 show an embodiment of the oil filter cap having a check valve.
Figure 39:
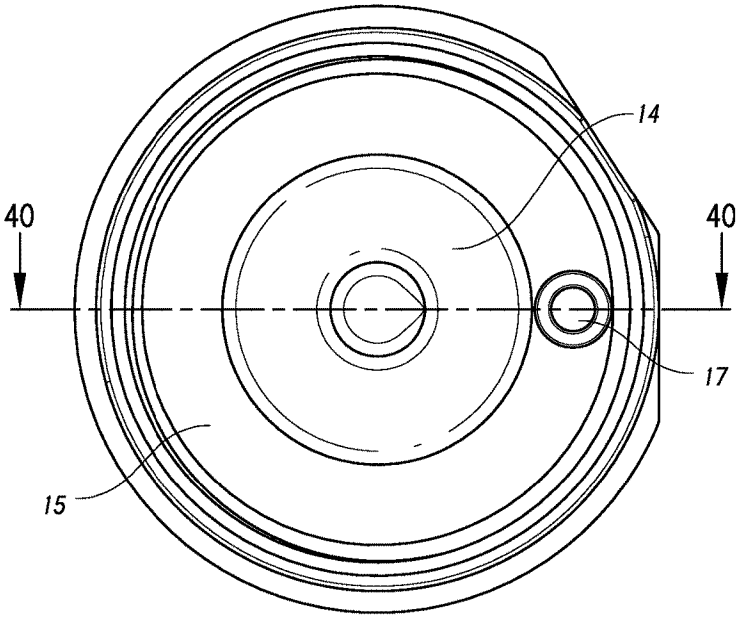
Figure 42:
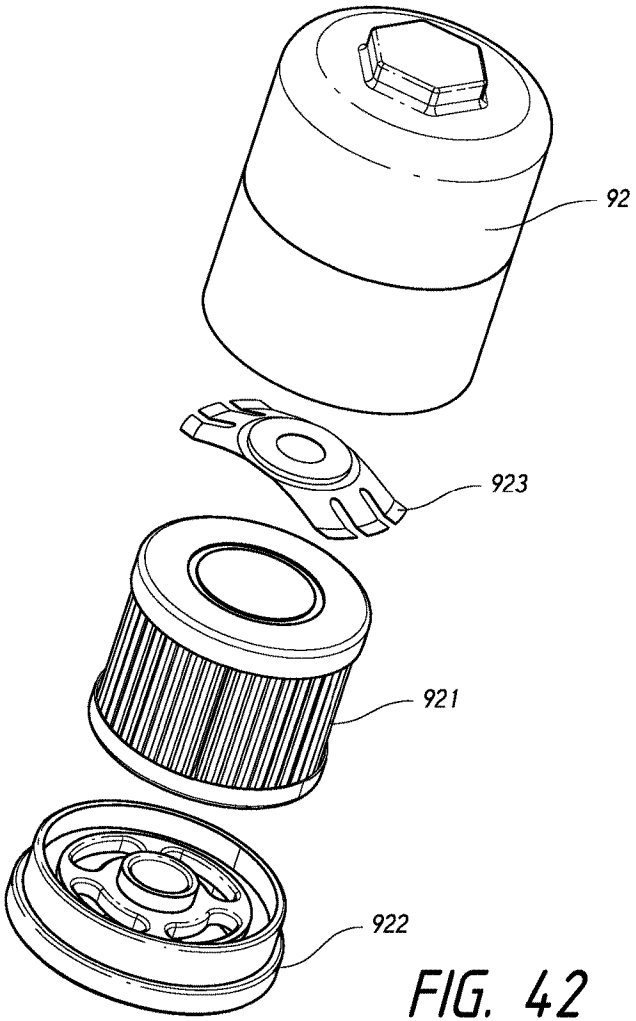
FIG. 42 shows an embodiment of internal aspects of the coolant filter housing upper.
Figure 41:
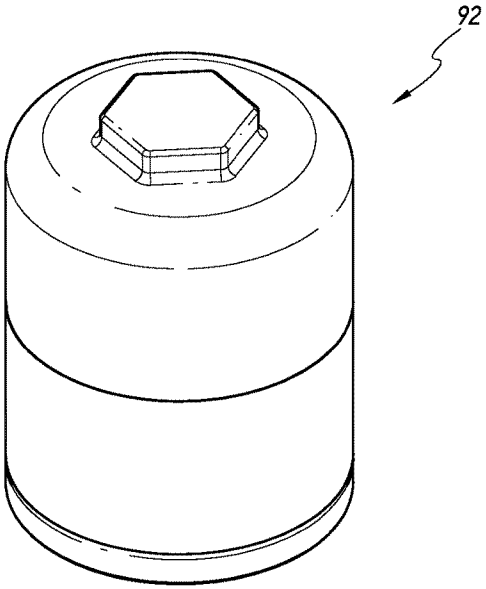
FIG. 41 shows an embodiment of the coolant filter housing upper.
Figure 44:
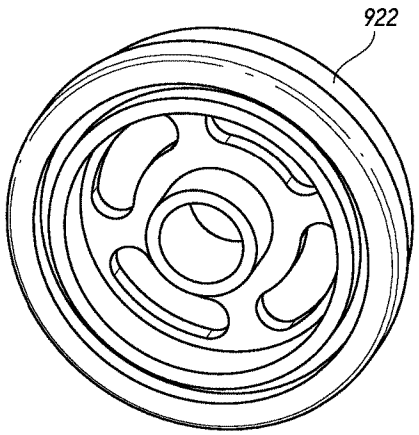
FIGS. 44 and 45 show views of an embodiment of the coolant filter base plate.
Figure 45:
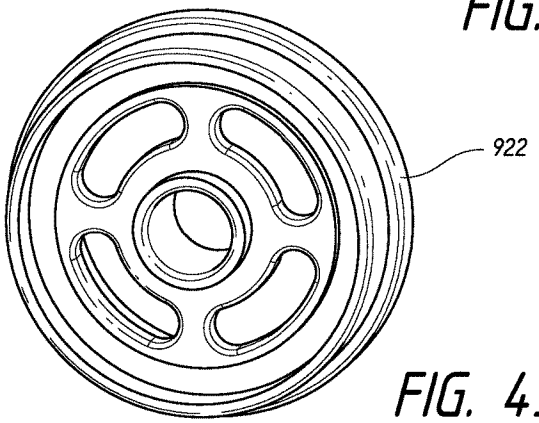
Figure 43:
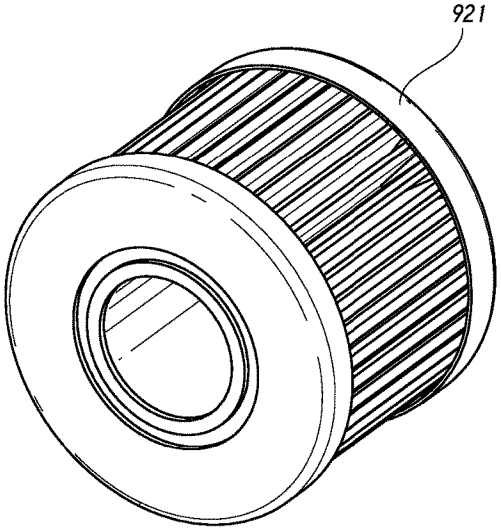
FIG. 43 shows an embodiment of the coolant filter.

Referring to FIGS. 39 and 40, an embodiment of the oil filter cap is shown. The oil filter cap 10 includes a check valve 17 that is in communication with the pre-filtered space 63, when installed, and the oil filter cap inlet 11. The check valve 17 will be actuated if the pressure in the pre-filtered space 63 reaches a predetermined point. Once that point is reached, pressure will be relieved by allowing oil flow through the check valve 17 and into the oil filter cap inlet 11. The pressure will be relieved in the pre-filter space and the check valve 17 should close again. In some embodiments, the check valve comprises a check valve ball 171, a check valve seat 172, and a check valve spring 173. The actuation pressure can the altered by the strength of the check valve spring 173 and/or the amount of the check valve ball 171 that is exposed to the pre-filtered space 63.

Figure 46:
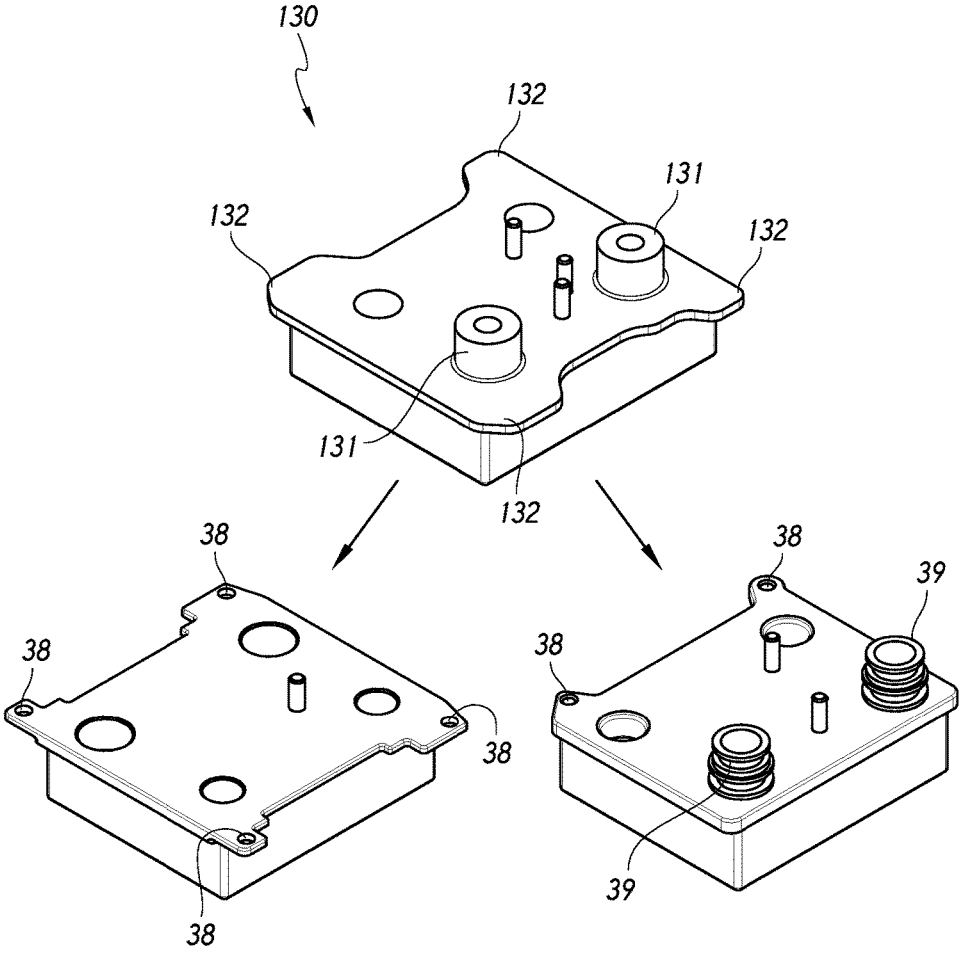
FIG. 46 shows an embodiment of the generic mold.
Figure 47:
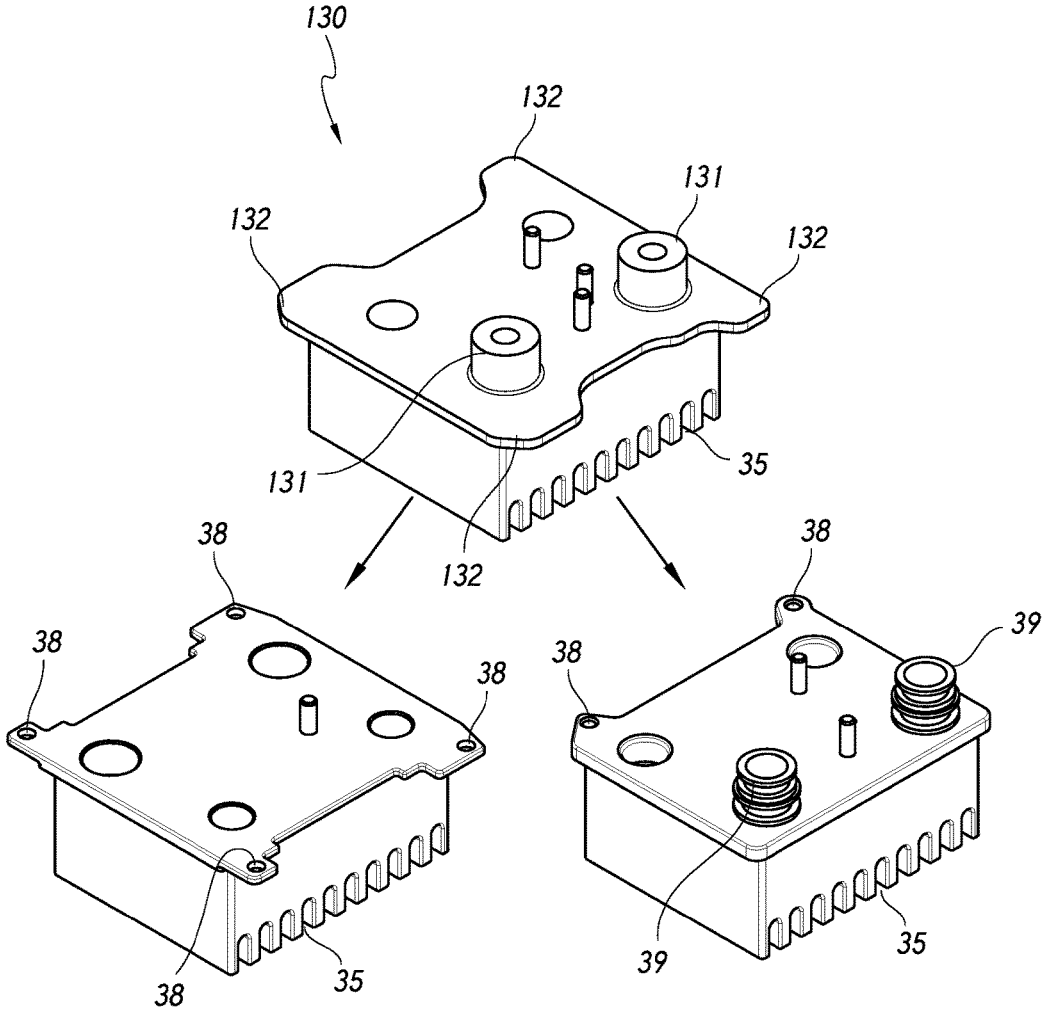
FIG. 47 shows an embodiment of the generic mold.

Referring to FIGS. 46 and 47, embodiments of the generic mold blank 130 is shown. The generic mold comprises an upper portion and a lower portion. The top portion is provided with pre-nipples 131, two openings in communication with the oil conduit, attachment wings 132, and multiple guide post. Inside the lower portion, the coolant chamber 36 and the oil conduit 37 are defined. The length and width of the lower portion are sized such that it may reside inside both the VT365 diesel engine block or a MAXXFORCE 7 diesel engine block in the place of the OEM oil heat exchanger. Some embodiments will have the flat bottom, as seen in FIG. 46, and other embodiments will have fins 35, as can be seen in FIG. 47. The generic mold blank 130 will allow the user to easily machine the desired bypass manifold 30. If the user desires a bypass manifold 30 with nipples and two guide post, the two pre-nipples will be machined into nipples 39 and a guide post will be removed. If the user desires a nipple free bypass manifold 30, the pre-nipples 131 and a guide post will be removed. Attachment holes can also be drilled in the attachment wings.

Figure 54:
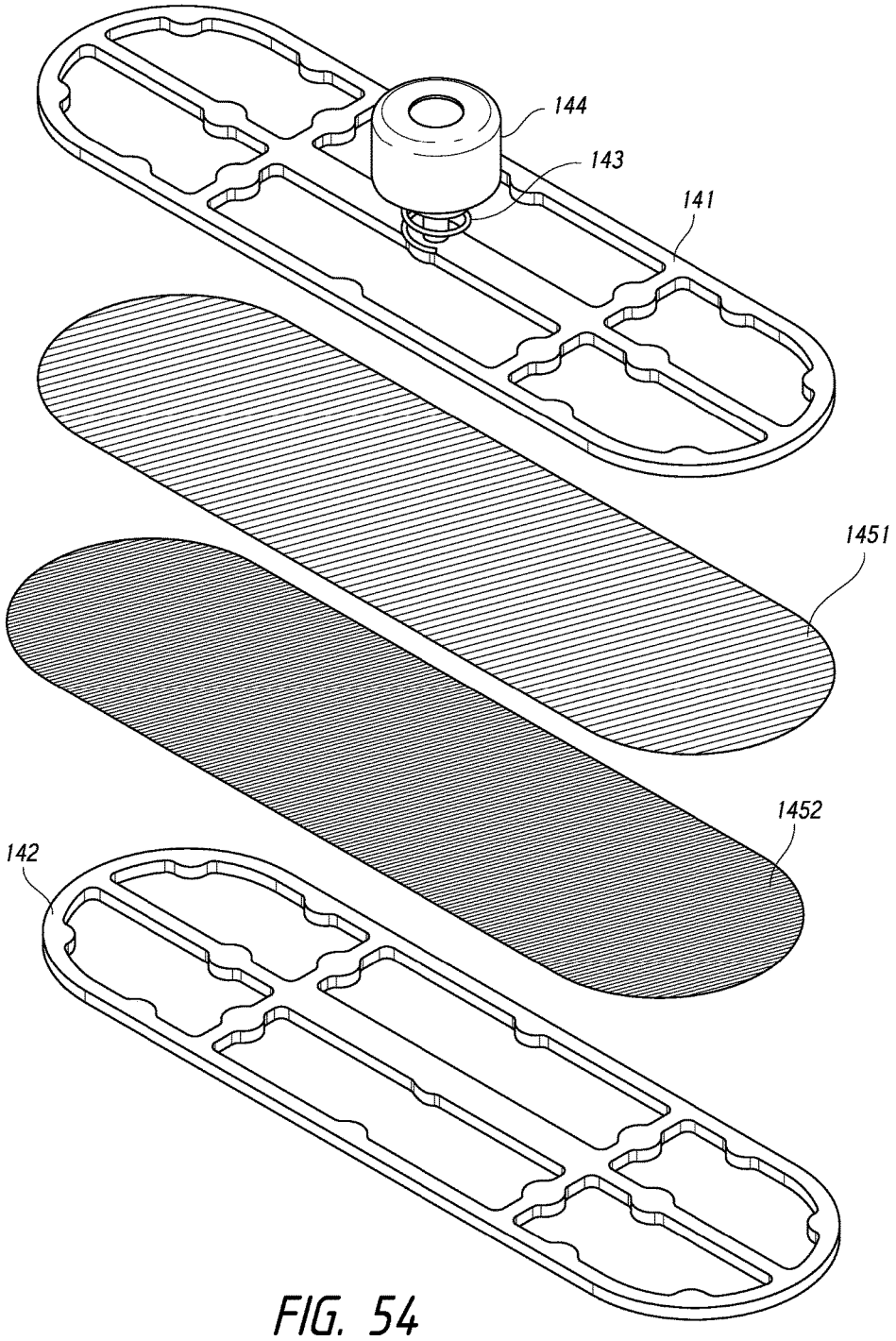
FIG. 54 shows an exploded embodiment of the high pressure filter screen.

Referring to FIGS. 52-55, some embodiments comprising of a high pressure filter screen 140. The high pressure filter screen 140 (HPFS) comprises an upper frame 141, a lower frame 142, and a screen 145. Some embodiments of the HPFS 140 will further comprise a HPFS spring 143 and a spacer 144. The screen comprises a filter screen 1451 and a reinforcing screen 1452 that are adjacent to each other. In some embodiments, the filter screen 1451 and the reinforcing screen 1452 are adhered together (e.g. welded). Referring to FIG. 54, in other embodiments, the reinforcing screen 1452 is not adhered to the filter screen 1451 and would be placed on the opposite side of fluid flow. The reinforcing screen 1452 can have a greater pore size than the filter screen 1451, as its main purpose is not filter but to reinforce the filter screen 1451. The HPFS can be used to filter the oil before it reaches the intake of a high pressure oil pump. The oil will flow through the screen 145, being filtered by one or more of the filter screens 1451 and for all intents and purposes flowing through the reinforcing screen 152, and into the intake of the high pressure oil pump. It is understood that some particles, due to their size, may be effectively filtered by the reinforcing screen 1452.

The filter screen 1451 and the reinforcing screen 1452 can be screens that have wires or other linear material in a crosshatch pattern defining pores. The wires can be individual wires or can be a single integral element that makes up the mesh. The pores can be in the shape of a square or some other polygon. The wires that make up the mesh, integral or not, can have a set or variable gauge. The filter screen 1451 can have a mesh count of 100 per inch. In some embodiments, the mesh count of the filter screen 1451 can be greater than 100 per inch.

A problem that occurs in high pressure situations is that the filter screen will incur a lot of stress from the pressure of the fluid flowing there through. Thus, many filters will increase the pore size to relieve the pressure of the fluid flow and/or the result of particles, which have been filtered but also create a blockage pressure on the filter. This will decrease the effeteness of the filters ability to filter contaminants. Thus the screen 145 can have a small effective pore size and maintain its structural integrity.

In some embodiments, the screen 145 will comprise two or more reinforcing screens 1452 located on one side or both sides of the filter screen 1451. In some embodiments, the screen 145 will comprise of two or more filter screens 1451 that are located on one side or both sides of the reinforcing screen 1452. In some embodiments, the filter will comprise of alternating filter screens 1451 and reinforcing screens 1452. The filter screens 1451 and the reinforcing screens can be heat pressed together and heated to a point that they are joined; spot welded together; and/or just held in place by being sandwiched between the upper frame 141 and the lower frame 142. The upper frame 141 and lower frame 142 can be made of a suitable material such as plastic, ceramics, metals, and/or alloys. In some embodiments, the upper frame 141 and the lower frame 142 comprise of aluminum. In some embodiments, they comprise of stainless steel. The upper frame 141 and the lower frame can be joined by means of welding, the use of adhesives, the use of fasteners (e.g. screws, bolts), heat bonded (e.g. mold bonded) and/or clips. The upper frame 141 and the lower frame 142 can also be formed integrally to form a single unitary piece of material with the screen 145 embedded therein. An o-ring or a gasket can be employed about the periphery of the frame to better form a seal with the engine block 70. It is also understood that the HPFS can further comprise of a gasket or an o-ring recess to accept a gasket or an o-ring.

The reinforcing screen(s) 1452 and the filter screen(s) 1451 can be made of the same or different materials. In some embodiments, the reinforcing screen 1452 and the filter screen 1451 comprise stainless steel wire. In some embodiments, the reinforcing screen 1452 will have a thicker gage and/or greater tensile strength than that of the filter screen 1451. It is understood that the shape of the HPFS 140 can be adjusted to fit the needs of the environment.

Figure 55:
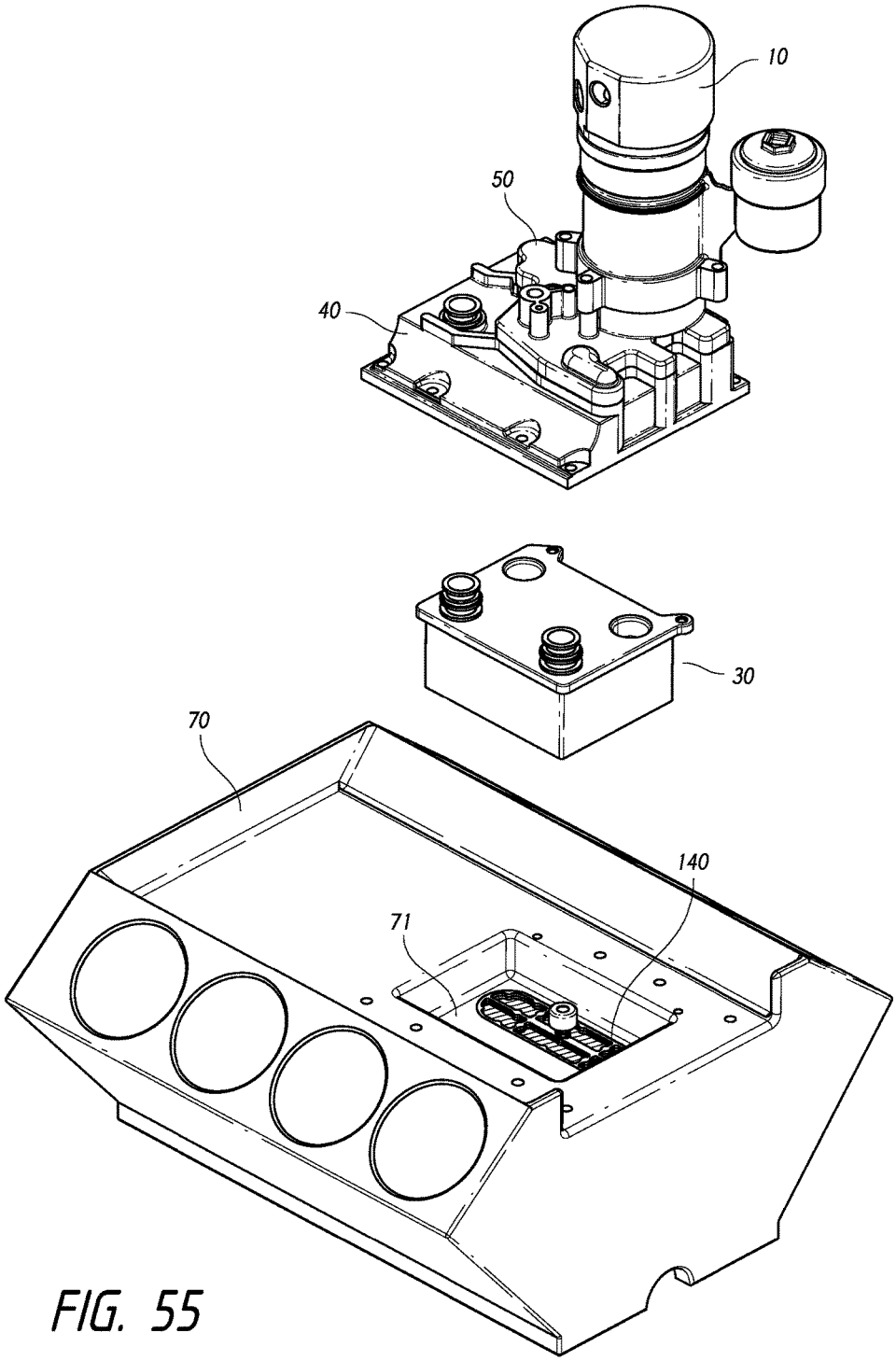
FIG. 55 shows an embodiment having the high pressure filter screen in an oil reservoir.

Referring to FIG. 55, the spacer 144 and the HPFS spring 143 provide a biasing force to keep the HPFS 140 in place within the oil reservoir 71. The spacer will abut a surface of the OEM oil heat exchanger 100 or the bypass manifold 30. The HPFS spring 143 will abut the upper frame 141 and the spacer 144. In some embodiments, the spacer 144 comprises polyoxymethylene.

Figure 56:
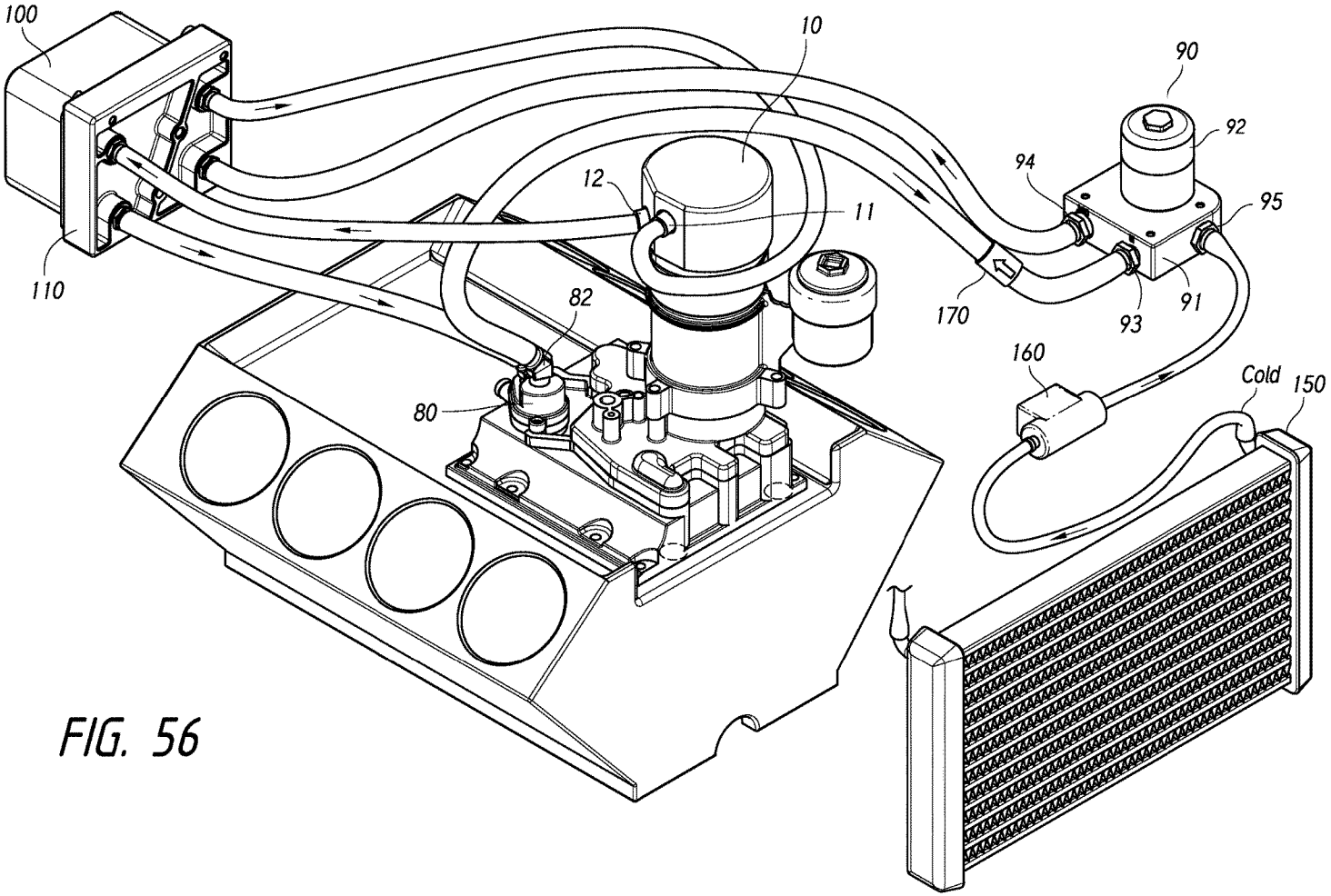
FIG. 56 shows an embodiment having a pump direct coolant from the radiator to a secondary coolant filter inlet.

Referring to FIG. 56 an embodiment is shown having a secondary coolant filter inlet 95 receiving coolant. The coolant can be driven by a pump 160. In some embodiments, the coolant is tapped at or near the radiator 150 coolant exit, the coolest the coolant will be during normal operation. The coolant will be pumped through the secondary coolant filter inlet 95 and through the filter 921. The pressure created by the pump will be greater than the pressure created by the water pump, at the coolant filter inlet 93, which is part of the engine. In the coolant pump, this pressure difference will create two effects. First the coolant from the pump 160 will take the path of least resistance and will flow through the coolant filter 921 and out the coolant filter outlet 94. The second effect will be that it will deny coolant entering in through the coolant inlet 93 passage through the coolant filter 90. Thus the cooler coolant will be entering the oil heat exchanger 100 and will serve to increase the effectiveness of the of the oil cooling system. In some embodiments, the pump 160 is selectively turned on, such that when it is not running, no coolant will flow through the secondary coolant filter inlet 95, and the system will run as described above. Once the pump is turned on, the coolant will flow through the secondary coolant filter inlet 95 and through the remainder of the system. The turning on of the pump can be performed by a manual switch, an automatic switch that responds to predetermined condition(s), or a manual switch that will allow an automatic system to work when predetermined condition(s) are met. The manual switch can be located in the interior of the vehicle. It can also be started as soon as the vehicle starts and/or once the thermostat on the radiator has actuated. The use of the pump and the secondary coolant filter inlet 95 will provide more efficient oil cooling. However, if the pump were to fail, the oil would still be cooled by the coolant entering the coolant filter inlet 93. This is can be useful because of the fact that pumps are known to fail. In some embodiments, a valve is used in the conduit prior to the entrance of the coolant filter inlet. The higher pressure of the pump will create some back pressure on the coolant directed to the coolant filter inlet 93. The valve will respond to this back pressure, actuate and prevent flow into the coolant filter inlet 93. The valve can be any valve that will cut flow in response to a predetermined back pressure. In some embodiments it is a check valve. In other embodiments it is an electronically actuated valve, e.g. solenoid, that will be turned on when the pump is turned on. In some embodiments the pump is an electronic pump. In other embodiments, the pump is belt driven and will run off the rotation of the engine.

In other embodiments, there is no be a secondary coolant filter inlet 95 and the conduit from the pump 160 will be connected directly to the coolant filter inlet 93. The coolant from the engine water pump that is designed to be destined for an oil heat exchanger 100 can be plugged or omitted.

While FIG. 56 shows the use of a coolant manifold 80, it is understood, that in some embodiments, a delete 120 with a delete manifold out 127 is used.

In some embodiments, certain elements are sold in a kit. A kit can comprise of one or more of the following:

an oil filter cap 10;
a transfer tube 20;
a bypass manifold 30;
an oil filter 61;
a coolant filter housing 90, with or without a secondary coolant filter inlet 95;
an adapter plate 110;
coolant manifold upper 85;
an oil heat exchanger 100, coolant cooled or air cooled;
high pressure filter screen 140;
a pump;
a delete 120, with or without a delete manifold out 127, delete return 128, and delete partition 129; and
instructions.

In some embodiments, the oil filter cap 10 and the transfer tube 20 can be designed to work with original equipment manufacture (OEM) parts for the designated kit. The oil filter cap 10 will be threaded so that it corresponds the OEM oil filter housing 60, and the transfer tube 20 will be designed so that it will correspond to the OEM oil cooler housing upper 50. As mentioned before, examples of suitable engines with OEM parts will be the VT365, also known as the 6.0 L POWERSTROKE in 2003-2007 model year FORD SUPER DUTY trucks and 2003-2010 model year FORD E-Series vans/chassis cabs, and the MAXXFORCE 7, also known as the 6.4 L POWERSTROKE in 2008-2010 model year FORD SUPER DUTY trucks, both of the NAVISTAR International Corporation.

In some embodiments, the oil filter cap 10 will comprise a check valve.

In embodiments of the kit with a bypass manifold, an oil filter cap 10, and a transfer tube 20, the end user will have the OEM oil heat exchanger 100 removed from the oil reservoir 71 and replace it with the bypass manifold 30. The transfer tube 20 and the oil filter cap 10 will be installed. In some embodiments, the instructions will include directions as to how to mount the OEM oil heat exchanger 100, or other heat exchanger 100, elsewhere so that it can still be used to cool the oil. As explained above, the oil can be routed out of the oil filter cap outlet 12 and back in via the oil filter cap inlet 11.

Other embodiments will include an oil heat exchanger 100. The oil heat exchanger 100 can be an air cooled heat exchanger or a coolant cooled heat exchanger.

Some embodiments will include gaskets and hoses, that will act as conduits to the respective parts. Other embodiments will contain pre-measured hoses with attachments that correspond to the parts that they will be attached to once assembled.

Embodiments including the coolant filter housing 90 can include a coolant filter 921. Some embodiments comprise the coolant manifold 80 or portions thereof. In some embodiments the coolant filter housing 90 will comprise a secondary coolant filter inlet 95.

It is understood that the coolant manifold upper 85 can be designed so that it will be secured to the OEM coolant manifold lower 84. It is also understood that the parts of the coolant manifold and/or portions thereof may come assembled or in parts. Other parts of the kit can also be fully assembled, partially assembled, and/or disassembled.

It is also understood that the components of the kit can include embodiments, described herein, of the respective components.

One embodiment of a kit can comprises one or more of the following:

1 pc. Coolant filter;
1 pc. Coolant filter housing upper 92;
1 Pc. Coolant filter housing lower 91;
1 pc. Coolant filter housing bracket;
2 pc. 6 mm×1 mm bolt 10 mm long;
2 pc. ¼" sheet metal screw ½" long;
2 pc. ¾ npt to ¾" barb fitting;
8 pcs. Hose clamps 9/16-1 1/16;
1 pcs. Plastic T-Fitting ¾" barb;
1 pcs. Aluminum T-fitting ¾" beaded 90 degree; and
10 ft. Heater hose, ¾"; and
Instructions.

One embodiment of a kit comprises one or more of the following:

1 pc. Delete 120;
1 pc. #318 Oring;
1 pc. #218 Oring;
1 pc. 8.125 mm Socket head bolt 30 mm long; and Instructions.

One embodiment of a kit comprises one or more of the following:

2 pcs. 8×1.25 flange nuts;
2 pcs. 8×1.25×25 mm studs;
2 pcs. 8×1.25×30 mm studs;
10 pcs. Hose clamps 9/16-1 1/16;
4 pcs. Push lock hose end straight;
10 ft Heater hose ¾";
1 pc. 36"¾" hose;
1 pc. 34"¾" hose;
2 pc. 90 degree ¾ NPT to ¾ barb;
2 pc. 90 degree elbow AN12 to ¾ NPT;
1 pc. 45 degree AN12 to ¾ NPT
1 pc. Straight AN12 to ¾ NPT
1 pc. Plastic T-Fitting ¾ barb;
1 pc. Aluminum T-fitting ¾ beaded 90 degree top;
4 pc. Oring #218;
1 pc. Oring #MOR300-03400 3×034 mm Oil cooler tube;
1 pc. Oring #MOR150-03800 1.50×038 Oil tube lower oring;
1 pc. Coolant filter;

1 pc. Oil filter cap 10;
1 pc. Oil Filter 51242 Wix;
1 pc. Transfer tube 20;
1 pc. Oil Cooler Adapter plate Material 7×8.625 $9, Machine;
1 pc. Oil cooler battery bracket;
1 pc. Oil Cooler 6.4;
Oil Cooler Gaskets;
Intake Gaskets;
1 pc. Oil Filter Cap Check valve housing $10, Spring $1.88, Ball $0.20;
2 pc. 12×1.5 bolt/plug for oil cap, JIS oring 9.8×2.4 NBR70 #P010A;
1 pc. Double wire 38" long, 38" loom; and
Instructions.

Another embodiment of a kit comprises:
a bypass manifold 30;
an oil transfer tube 20;
an oil filter cap 10;
an oil filter;
2 oil hoses;
a coolant hose of approximately 10 feet (Or multiple hoses that equal anywhere from 9.5 feet to 10.5 feet);
a liquid cooled oil heat exchanger 100;
an adapter plate 110;
a coolant filter housing 90;
a coolant filter 921; and
a coolant manifold upper 85.

Another embodiment comprises:
a coolant filter housing 90;
a coolant filter 921;
a coolant hose of approximately 10 feet; and
any number of bolts, mounting brackets and hose clamps.

The embodiment may or may not have a coolant manifold upper 85.

Some kits comprise of a delete 120. The delete 120 can have a delete partition 129. The delete partition 129 can be integral or an element inserted therein. Some kits, comprising a delete 120, include gaskets, an oil heat exchanger 100, an OEM uppipe, or a combination thereof.

Some kits will include a HPFS 140.

It is understood that all embodiments of the kit can include instructions. For the embodiments comprising instructions, those instructions comprise of direction to an end user as to how to install the components of the kit that are included therein. The instructions can comprise direction as to install the components according to any or all of the above embodiments. For example, for a kit comprising a coolant manifold, the instructions will comprise direction on how to install the coolant manifold; for a kit comprising a bypass manifold, the instructions will comprise direction on how to install the manifold; and for a kit comprising a bypass manifold and a coolant manifold, the instructions will comprise direction on how to install both. It is clear to one of skill in the art, in view of the disclosure, the content that the instructions may provide.

It is also understood that a method for installing the components described above is readily apparent from the above disclosure. In some embodiments, the method includes the insulation of the above mentioned oil transfer tube 20, an oil filter cap 10, a bypass manifold 30, a coolant manifold 80, an adapter plate 110, a coolant filter housing 90, a high pressure filter screen 140, an oil heat exchanger 100, and/or a delete 120 in the VT365 engine. In some embodiments, the method includes the insulation of the above mentioned oil transfer tube 20, an oil filter cap 10, a bypass manifold 30, a coolant manifold 80, an adapter plate 110, a coolant filter housing 90, a high pressure filter screen 140, an oil heat exchanger 100, and/or a delete 120 in the MAXXFORCE 7 engine. These methods include the removal and/or placement of OEM parts. Given that the design of the VT365 and MAXXFORCE 7 engines are well known, the methods of removing OEM parts of these engines and/or placing them in other locals, and the placement of the components described above is disclosed to one of skill in the art.

It is to be understood that the above-described embodiment is intended to illustrate rather than limit the disclosure. Variations may be made to the embodiment without departing from the spirit of the disclosure as claimed. The above-described embodiments are intended to illustrate the scope of the disclosure and not restricted to the scope of the disclosure.

It is also to be understood that the above description and the claims drawn to a method may include some indication in reference to certain steps. However, the indication used is only to be viewed for identification purposes and not as a suggestion as to an order for the steps.

What is claimed is:

1. An apparatus comprising:
an oil filter cap comprising an oil filter cap inlet, an oil filter cap outlet, and a transfer tube seat;
an oil filter; and
a transfer tube comprising a transfer tube inlet, a transfer tube outlet, and a transfer tube seal;
wherein the transfer tube is solid, such that fluid can only flow through the transfer tube via the transfer tube inlet and the transfer tube outlet; the transfer tube seal abuts the transfer tube seat; the oil filter is at least partially received in the oil filter cap; and the oil filter cap inlet is in communication with the transfer tube.

2. The apparatus of claim 1, wherein the oil filter and the transfer tube define a post filtered space, and the post filtered space is in communication with the oil filter cap outlet.

3. The apparatus of claim 2, further comprising an oil filter housing; wherein the oil filter housing and the oil filter define a pre-filtered space.

4. The apparatus of claim 1 further comprising a bypass manifold comprising a bypass manifold coolant outlet, a bypass manifold coolant inlet, a bypass manifold oil outlet, a bypass manifold oil inlet, a coolant chamber, and an oil conduit; wherein the bypass manifold oil outlet is in communication with the oil filter cap outlet.

5. The apparatus of claim 4, wherein the bypass manifold further comprises fins on an exterior portion thereof.

6. The apparatus of claim 4, wherein the coolant chamber has a volume larger than the oil conduit.

7. The apparatus of claim 4, wherein the bypass manifold at least partially resides in an oil reservoir.

8. The apparatus of claim 1, further comprising an oil heat exchanger; wherein the oil heat exchanger comprises an oil heat exchanger oil inlet and an oil heat exchanger oil outlet; and the oil filter cap outlet is in communication with the oil heat exchanger oil inlet, and the oil heat exchanger oil outlet is in communication with the oil filter cap inlet.

9. The apparatus of claim 8, wherein the oil heat exchanger is not located in an engine block and is a coolant cooled heat exchanger.

10. The apparatus of claim 9, further comprising an adapter plate located adjacent to the oil heat exchanger.

11. The apparatus of claim 1, further comprising a coolant manifold; wherein the coolant manifold comprises a coolant manifold upper and a coolant manifold lower, wherein the coolant manifold upper comprises a coolant manifold outlet and a coolant manifold inlet, and the coolant manifold lower comprise a coolant manifold lower outlet; and the coolant manifold inlet is in communication with the coolant manifold lower outlet.

12. The apparatus of claim 4, further comprising a coolant manifold; wherein the coolant manifold comprises a coolant manifold upper and a coolant manifold lower, wherein the coolant manifold upper comprises a coolant manifold outlet and a coolant manifold inlet, and the coolant manifold lower comprise a coolant manifold lower outlet; and the coolant manifold inlet is in communication with the coolant manifold lower outlet.

13. The apparatus of claim 11, further comprising a coolant filter housing, wherein the coolant filter housing comprises coolant filter inlet and a coolant filter outlet; and the coolant manifold outlet is in communication with the coolant filter inlet.

14. The apparatus of claim 8, further comprising a coolant manifold, and the oil heat exchanger further comprises an oil heat exchanger coolant inlet and an oil heat exchanger coolant outlet; wherein the coolant manifold comprises a coolant manifold outlet, a coolant manifold inlet, and a coolant manifold lower outlet; and the coolant manifold inlet is in communication with both the oil heat exchanger coolant outlet and the coolant manifold lower outlet.

15. The apparatus of claim 14, further comprising a coolant filter housing, wherein the coolant filter housing comprises coolant filter inlet and a coolant filter outlet; the coolant manifold outlet is in communication with the coolant filter inlet; and the coolant filter outlet is in communication with the oil heat exchanger coolant inlet.

16. The apparatus of claim 8, further comprising a coolant filter housing, and the oil heat exchanger further comprises an oil heat exchanger coolant inlet and an oil heat exchanger coolant outlet; wherein the coolant filter housing comprises coolant filter inlet and a coolant filter outlet; and the coolant filter outlet is in communication with the oil heat exchanger coolant inlet.

17. The apparatus of claim 1, further comprising a delete; wherein the delete comprises a delete coolant inlet, and a delete coolant outlet, delete support flange, a delete attachment; and the delete is formed from a single piece of material.

18. The apparatus of claim 1, further comprising a delete; wherein the delete comprises a delete coolant inlet, a delete coolant outlet, a manifold out, a delete return and a delete partition; wherein the delete coolant inlet and the delete manifold out are in direct communication, the delete coolant outlet and the delete return are in direct communication, and the delete partition separates the delete return and the delete partition from direct communication.

19. The apparatus of claim 18, further comprising a coolant filter housing, wherein the coolant filter housing comprises coolant filter inlet and a coolant filter outlet; and out the delete manifold out is in communication with the coolant filter inlet.

20. An apparatus comprising:

an oil filter cap comprising an oil filter cap inlet, an oil filter cap outlet, and a transfer tube seat;

an oil filter at least partially received in the oil filter cap; and a transfer tube comprising a transfer tube inlet, and a transfer tube seal;

wherein the transfer tube seal abuts the transfer tube seat about the transfer tube inlet; and the oil filter cap inlet is in direct communication with the transfer tube center, such that fluid, from the oil filter cap inlet, flows out the oil filter cap directly into the transfer tube inlet without passing through the oil filter.

21. An apparatus comprising:

an oil filter cap comprising an oil filter cap inlet, an oil filter cap outlet, and a transfer tube seat;

an oil filter at least partially received in the oil filter cap; and a transfer tube comprising a transfer tube inlet and a transfer tube seal;

wherein the transfer tube seal abuts the transfer tube seat about the transfer tube inlet; and the oil filter cap inlet is in direct communication with the transfer tube inlet.

* * * * *